US006836246B1

(12) United States Patent
Kadambi et al.

(10) Patent No.: US 6,836,246 B1
(45) Date of Patent: Dec. 28, 2004

(54) DESIGN OF SINGLE AND MULTI-BAND PIFA

(75) Inventors: Govind R. Kadambi, Lincoln, NE (US); Kenneth D. Simmons, Lincoln, NE (US); Thomas F. Masek, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/495,604

(22) Filed: Feb. 1, 2000

(51) Int. Cl.[7] ..... H01Q 1/38
(52) U.S. Cl. ..... 343/700 MS; 343/702
(58) Field of Search ..... 343/700 MS, 702, 343/846, 848, 829, 843, 866, 749

(56) References Cited

U.S. PATENT DOCUMENTS 5,764,190 A * 6/1998 Murch et al. ..... 343/702
5,926,139 A * 7/1999 Korisch ..... 343/702
5,966,097 A * 10/1999 Fukasawa et al. ... 343/700 MS
6,034,636 A * 3/2000 Saitoh ..... 343/700 MS
6,222,496 B1 * 4/2001 Liu ..... 343/846
6,225,958 B1 * 5/2001 Amano et al. ..... 343/767
6,252,552 B1 * 6/2001 Tarvas et al. ..... 343/700 MS
6,278,369 B2 * 8/2001 Smith et al. ..... 340/572.7
6,339,402 B1 * 1/2002 McKivergan ..... 343/702

OTHER PUBLICATIONS

"Dual–Frequency Planar Inverted–F Antenna", by Zi Dong Liu, et al., published Oct. 1997 in IEEE Transactions on Antennas and Propagation, vol. 45, No. 10.
"Optimising the Radiation Pattern of Dual–Frequency Inverted–F Planar Antennas", by Pawel Kabacik, et al., publication and date unknown, pp. 655–658.
"The C–Patch: A Small Microstrip Element", by G. Kossiavas, et al., published Dec. 15, 1998, publication unknown.
"Double C–Patch Antennas Having Different Aperture Shapes", by Mohamed Sanad, publication and date unknown, pp. 2116–2119.

* cited by examiner

*Primary Examiner*—Shih-Chao Chen
(74) *Attorney, Agent, or Firm*—Holland & Hart LLP

(57) ABSTRACT

A Planar Inverted-F Antenna (PIFA) comprising a radiating element, a ground plane located below the radiating element; a through hole located at a position corresponding to the radiating element, a power feeding connector pin at a position corresponding to the radiating element; a through hole at a position corresponding to the radiating element; a conductive shorting post (pin) located at a position corresponding to the radiating element; a right side vertical plane formed along the edge of the radiating element; a left side vertical plane formed along the other edge of the radiating element; a lower horizontal plane formed by bending the left side vertical plane; a slot on the radiating element; and a dielectric block located in the area between the lower horizontal plane and the ground.

24 Claims, 19 Drawing Sheets

DESIGN OF SINGLE AND MULTI-BAND PIFA

BACKGROUND OF THE INVENTION

1. Field of the Invention

The present invention relates to Planar Inverted-F Antenna (PIFA) and, in particular, to a method of designing a single and multi-band PIFA with a single feed.

2. Description of the Related Art

The cellular communication industry has experienced an enormous growth in recent years. Of late there has been an increasing emphasis on internal antennas for cellular handsets instead of a conventional external wire antenna. The conventional external wire antenna on a cellular handset exhibits an Omni directional radiation pattern in the azimuth plane. This results in a portion of transmitted power being lost by absorption into the user's head and consequently leads to a higher value of Specific Absorption Rate (SAR). Internal antennas have several advantageous features such as being less prone for external damage, a reduction in overall size of the handset with optimization, easy portability, and potential for low SAR characteristics. The concept of internal antenna stems from the avoidance of protruding external radiating element by the integration of the antenna into the handset. The printed circuit board of the cellular handset serves as the ground plane of the internal antenna, and also acts to shield RF energy from user's head. This shielding/blockage effect reduces the power radiated in the direction of the user's head resulting in an improvement in the front to back (F/B) ratio of the radiation pattern of the internal antenna and lower value of SAR. Among the various choices for cellular internal antennas, PIFA appears to have great promise. The PIFA is characterized by many distinguishing properties such as being relatively lightweight, ease of adaptation and integration into the phone chassis, moderate range of bandwidth, Omni directional radiation patterns in orthogonal principal planes for vertical polarization, versatility for optimization, and multiple potential approaches for size reduction. A possible placement for PIFA inside a typical cellular handset to function as an internal antenna is shown in FIG. 10. The PIFA also finds useful applications in diversity schemes. Its sensitivity to both the vertical and horizontal polarization is of immense practical importance in mobile cellular communication applications because the antenna orientation is not fixed. All these features render the PIFA to be a good choice as an internal antenna for mobile cellular handsets. Despite all of the desirable features of a PIFA, the PIFA has the limitation of a rather large physical size for practical application. A conventional PIFA should have the semi-perimeter of its radiating element (sum of the length and the width) equal to ¼ of a wavelength at the desired frequency. One-quarter of a wavelength at the center of AMPS frequency band (824–894 MHz) is 87.31 mm while the corresponding value at the center of GSM frequency band (880–960 MHz) is 81.52 mm. With the rapidly advancing size miniaturization of the cellular handset, the space requirement of a conventional PIFA is a severe limitation for practical application. Thus, there is a need for an efficient design technique to reduce the size of the PIFA, in order to realize a practical utility of the PIFA for cellular frequency bands.

Rapid expansion of the cellular communication industry in the recent past has created a need for multi-frequency band operation cellular handsets to meet the ever-increasing subscriber demand. In a typical multi-frequency band cellular handset with a single Duplexer, a multi-frequency band antenna with a single feed is the most viable option. Few attempts have been made in the past to design multi-frequency band PIFA with a single feed due to the complexity of design and difficulty in achieving acceptable bandwidths for the resonant bands desired. Multi-band PIFA designs have been realized in the past by using a separate feed path for each band. There is a great concern for a multi-band PIFA design with multiple feed paths having its performance compromised due to the mutual coupling and poor isolation of the various resonant bands. Therefore, the multi-band PIFA with multiple feed paths has not been a logical choice for practical applications in multi-frequency band cellular operations. Therefore, the design of single feed multi-band PIFA has been a topic of specific emphasis and special relevance to cellular communication.

A typical placement of a PIFA placed inside the housing of a typical cellular handset to function as an internal antenna is illustrated in FIG. 10. FIG. 10 is a schematic cut-away side view of a typical cellular handset 40 with an internal antenna 42. Cellular handset 40 includes a housing 41 in which antenna 42 and other accessories are enclosed. Among other things, the accessories of a cellular handset include a speaker 43, display 44, keypad 45, microphone 46, battery 47 and a printed circuit board 48 containing various electronic cards. Speaker 43 and microphone 46 define a user direction. When the cellular handset is in use with the keypad 45 pointing towards user's head, the speaker 43 is placed in the vicinity of user's ear and the microphone 46 is placed in the close proximity of the user's mouth. In FIG. 10, the internal antenna 42 is placed directly over the printed circuit board 48 implying that the printed circuit board 48 also serves as a ground plane for the antenna 42. The internal antenna may also have a separate ground plane. In such a case, the ground plane of the internal antenna 42 is placed over the printed circuit board 48. The radiating element of the internal antenna 42 is oriented in a direction away from user's head. The printed circuit board 48 which is located in the region between the internal antenna 42 and the user's head, blocks a significant amount of the RF field radiated by the antenna 42 in the direction of the user's head. Such a blockage effect offered by the printed circuit board 48 results in a dip or null in the radiation pattern of the antenna over an angular sector comprising the direction of the user's head also. Consequently, the amount of RF power of the internal antenna 42 transmitted in the direction of the user's head is considerably reduced resulting in low value of specific absorption rate (SAR).

A conventional prior art single band PIFA assembly is illustrated in FIGS. 11A and 11B. The PIFA 110 shown in FIG. 11A and FIG. 11B consists of radiating element 101, ground plane 102, connector feed pin 104*a*, and conductive post or pin 107. A power feed hole 103 is located corresponding to the radiating element 101. Connector feed pin 104*a* serves as a feed path for radio frequency (RF) power to the radiating element 101. The connector feed pin 104*a* is inserted through the feed hole 103 from the bottom surface of the ground plane 102. The connector feed pin 104*a* is electrically insulated from the ground plane 102 where the pin passes through the hole in the ground plane 102. The connector feed pin 104*a* is electrically connected to the radiating element 101 at 105*a* with solder. The body of the feed connector 104*b* is electrically connected to the ground plane at 105*b* with solder. The connector feed pin 104*a* is electrically insulated from the body of the feed connector 104*b*. A through hole 106 is located corresponding to the radiating element 101, and a conductive post or pin 107 is inserted through the hole 106. The conductive post 107 serves as a short circuit between the radiating element 101 and the ground plane 102. The conductive post 107 is electrically connected to the radiating element 101 at 108*a* with solder. The conductive post 107 is also electrically connected to the ground plane 102 at 108*b* with solder. The resonant frequency of the PIFA 110 is determined by the length (L) and width (W) of the radiating element 101 and is slightly affected by the locations of the feed pin 104*a* and the shorting pin 107. The impedance match of the PIFA 110 is achieved by the adjusting of the diameter of the connector feed pin 104*a*, by adjusting the diameter of the conductive shorting post 107, and by adjusting the separation distance between the connector feed pin 104*a* and the conductive shorting post 107. The fundamental limitation of the configuration of the PIFA 110 described in FIG. 11A and FIG. 11B is the requirement of relatively large dimensions of length (L) and width (W) of the radiating element 101 to achieve resonance in the desired cellular frequency bands (AMPS/GSM). This configuration is limited to only single operating frequency band applications.

The prior art techniques to reduce the physical size of the PIFA, while maintaining the resonance in the desired frequency bands include capacitive loading and dielectric loading. The dielectric loading increases the weight and cost of the PIFA while the capacitive loading in the prior art increases the mechanical complexity of the design, thus making it difficult and more expensive to manufacture. The details of these techniques are described below and are accompanied with illustrations. The elements of the PIFA configured with the capacitive loading and dielectric loading techniques which are similar to that of the conventional PIFA 110, will have the same reference numbers as in FIG. 11A and FIG. 11B. Therefore, additional redundant reference explanations have been omitted.

A prior art PIFA 120 with conventional capacitive loading is illustrated in FIGS. 12A and 12B. Plate 109 is placed parallel to the ground plane 102 and functions as a capacitive loading element for the radiating element 101. Plate 109 is separated from the ground plane 102 by a specific distance. The structural configuration of PIFA 120 with capacitive loading element as illustrated in FIG. 12A and FIG. 12B increases complexity and adds several steps to the manufacturing process. This results in an increased cost of this PIFA design.

A prior art PIFA 130 with conventional dielectric loading is illustrated in FIG. 13A and FIG. 13B. The entire area between the radiating element 101 and the ground plane 102 is filled with a block of dielectric material 110 of a specified dielectric constant. The introduction of the block of dielectric material into the antenna increases the weight and cost of the PIFA. The block of dielectric material 110 in the entire area of the PIFA also increases the dielectric loss and hence causing lower RF energy radiation efficiency.

A description of some prior art configurations of multi-band PIFA with multiple feeds and single feed is as follows. A prior art multi-band PIFA 140 with a separate feed for each band is illustrated in FIG. 14A, FIG. 14*b* and FIG. 14C. This configuration is a modification of the single band conventional PIFA 110 explained in FIG. 11A and FIG. 11B. As can be seen in FIGS. 14A, 14B and 14C, the multi-band PIFA 140 consists of two radiating elements 201*a* and 201*b* resonating at two separate frequency bands. The radiating elements 201*a* and 201*b* are positioned above a common ground plane 202. A narrow L-shaped slot 203 offers a physical division and electrically separates the two radiating elements 201*a* and 201*b*. A hole 204 is located corresponding to the radiating element 201 *a*. A connector feed pin 205*a*, used for feeding radio frequency (RF) power to the radiating element 201*a*, is inserted through hole 204 from the bottom surface of the ground plane 202. The connector feed pin 205*a* is electrically insulated from the ground plane 202 where the pin passes through the hole in the ground plane 202. The connector feed pin 205*a* is electrically connected to the radiating element 201*a* at 206*a* with solder. The body of the feed connector 205*b* is connected to the ground plane at 206*b* with solder. The connector feed pin 205*a* is electrically insulated from the body of the feed connector 205*b*. A through hole 207 is located corresponding to the radiating element 201*a*. A conductive post or pin 208 which functions as a short circuit between the radiating element 201*a* and the ground plane 202 is inserted through the hole 207. The conductive post 208 is electrically connected to the radiating element 201*a* at 209*a* with solder. The conductive post 208 is connected to the ground plane 202 at 209*b* with solder. The radiating element 201*a* with relatively larger dimensions of length (L1) and width (W1) resonates at the lower frequency band of the multi-band operation.

The impedance match of the radiating element 201*a* is determined by the diameter of the connector feed pin 205*a*, the diameter of the conductive shorting post 208 and the distance of separation between the connector feed pin 205*a* and the conductive shorting post 208. The radiating element 201*b* with relatively smaller dimensions of length (L2) and width (W2) resonates at the higher frequency band of multi-band operation. A power feed hole 210 is located corresponding to the radiating element 201*b*. A connector feed pin 211*a*, used to feed radio frequency (RF) power to the radiating element 201*b*, is inserted through the feed hole 210 from the bottom surface of the ground plane 202. The connector feed pin 211*a* is electrically insulated from the ground plane 202 where the feed pin passes through the hole in the ground plane 202. The connector feed pin 211*a* is electrically connected to the radiating element 201*b* at 212*a* with solder. The body of the feed connector 211*b* is connected to the ground plane 202 at 212*b* with solder. The connector feed pin 211*a* is electrically insulated from the body of the feed connector 211*b*. A through hole 213 is located corresponding to the radiating element 201*b*. A conductive post or pin 214, which creates as a short circuit between the radiating element 201*b*, and the ground plane 202 is inserted through the hole 213. The conductive post 214 is electrically connected to the radiating element 201*b* at 215*a* with solder. The conductive post 214 is soldered to the ground plane 202 at 215*b*. The impedance match of the radiating element 201*b* is determined by the diameter of the connector feed pin 211*a*, the diameter of the conductive shorting post 214 and the distance of separation between the connector feed pin 211*a* and the conductive shorting post 214.

The configuration of multi-band PIFA 140 illustrated in FIG. 14A and FIG. 14B has several disadvantages. Such a configuration of the PIFA can be used only in a multi-band cellular handset with two Duplexers. However, the majority of currently manufactured cellular handsets have only one Duplexer. Adequate isolation between the two frequency bands requires a larger separation between the radiating elements 201*a* and 201*b* necessitating larger width of the L-shaped slot 203. The increased width of the L-shaped slot without increase of the overall dimensions of the radiating elements 201*a* and 201*b* reduces the bandwidth of the PIFA. Any change in the separation between the two resonant frequency bands involves the change of linear dimensions of the radiating elements 201*a* and 201*b*.

Z. D. Liu, P. S. Hall and D. Wake, "Dual Frequency Planar Inverted-F Antenna", IEEE Trans. Antennas and Propagation, Vol. AP-45, No. 10, pp. 1451–1548, October 1997 (hereinafter referred to as Liu et al.) describes a multi-band PIFA with separate feeds with structural configuration similar to the one illustrated in FIG. 14A, FIG. 14B and FIG. 14*c*. P. Kabacik and A. A. Kuchaski, "Optimising the Radiation Pattern of Dual, Frequency Inverted-F Planar Antennas", JINA Conference, pp. 655–658, 1998 (hereinafter referred to as Kabacik et al.) also describes a multi-band PIFA with separate feeds with similar configuration to the one illustrated in FIG. 14A, FIG. 14B and FIG. 14C. Instead of an L-shaped slot 203 separating the two radiating elements as in FIGS. 14A and 14B, a U-shaped slot has been proposed by Kabacik et al.

A prior art multi-band PIFA 150 with a single feed is illustrated in FIG. 15A and FIG. 15B. The multi-band PIFA 150 consists of a radiating element 301 and a ground plane 302. An L-shaped slot 303 on the radiating element 301 creates a quasiphysical partitioning of the radiating element 301. The segment on the radiating element 301 with dimensions of length (L1) and width (W1) resonates at the lower frequency band of the multi-band operation. The segment on the radiating element 301 with dimensions of length (L2) and width (W2) resonates at the upper frequency band of the multi-band operation. A power feed hole 304 is located corresponding to the radiating element 301. A connector feed pin 305*a*, used for feeding radio frequency (RF) power to the radiating element 301, is inserted through the feed hole 304 from the bottom surface of the ground plane 302. The connector feed pin 305*a* is electrically insulated from the ground plane 302 where the feed pin passes through the hole in the ground plane 302. The connector feed pin 305*a* is electrically connected to the radiating element 301 with solder at 306*a*. The body of the feed connector 305*b* is connected to the ground plane 302 at 306*b* with solder. The connector feed pin 305*a* is electrically insulated from the body of feed connector 305*b*. A through hole 307 is located corresponding to the radiating element 301. A conductive post or pin 308 which functions as a short circuit between the radiating element 301 and the ground plane 302 is inserted through the hole 307. The conductive post 308 is connected to the radiating element 301 at 309*a* with solder. The conductive post 308 is also connected to the ground plane 302 at 309*b* with solder. The multi-frequency band impedance match of the radiating element 301 is determined by the diameter of the connector feed pin 305*a*, the diameter of the conductive shorting post 308 and the separation distance between the connector feed pin 305*a* and the conductive shorting post 308. The main disadvantage of the configuration of the multi-band PIFA 150 illustrated in FIG. 15A and FIG. 15B is the lack of simple means of adjusting the separation of the lower and upper resonant frequency bands. The change in the separation of the resonant frequency bands requires the repositioning of the slot 303. Liu et al. describes a configuration of a single feed multi-band PIFA, which is similar to the one described in FIG. 15A and FIG. 15B. In the single feed multi-band PIFA configuration of Liu et al., the concept of dielectric loading illustrated in FIG. 13A and FIG. 13B has also been invoked.

SUMMARY OF THE INVENTION

In the first embodiment of the invention, the single feed multi-band PIFA is characterized by a radiating element located above the ground plane, a shorting pin or post along the centerline of the radiating element adjacent to the power feeding connector pin, a vertical loading plate on the radiating edge adjacent to the power feeding connector pin, a horizontal loading plate on the other radiating edge adjacent to the shorting post, and a block of dielectric material of a specific dielectric constant filling the area between the horizontal loading plate and the ground plane. In a second embodiment of the invention, PIFA is essentially the same as in the first embodiment except that in the second embodiment, a slot loading technique to adjust the resonant frequency of desired bands is described. A third embodiment of the invention is in the design of a single band PIFA having reduced dimensions of the radiating element including the concepts of slot loading, modified capacitive loading and partial dielectric loading combined therein.

One of the principal objects of the invention is to circumvent the use of separate feeds for the realization of multi-band operation of a PIFA.

A further object of the invention is to provide an efficient design method to achieve the multi-band operation of a PIFA using only a single feed path.

Still another object of the invention is to provide a single feed multi-band PIFA which is devoid of currently imposed physical partition of the original structure of a single band PIFA.

Still another object of the invention is to provide a design of a single feed multi-band PIFA which has the merit of relative ease of adjusting the separation between the resonant bands without necessitating a dimensional change of the radiating element.

Still another object of the invention is to provide a single feed multi-band PIFA configuration having the desirable features of configuration, simplicity, compact size, cost-effectiveness to manufacture and improved manufacturability.

Still another object of the invention is to provide a compact single band PIFA.

Still another object of the invention is to provide a design of the type described above which involves a combination of a modified prior art capacitive loading technique, a technique of partial dielectric loading and a technique of slot loading.

These and other objects will be apparent to those skilled in the art.

DESCRIPTION OF THE PREFERRED EMBODIMENTS

Figure 1A:
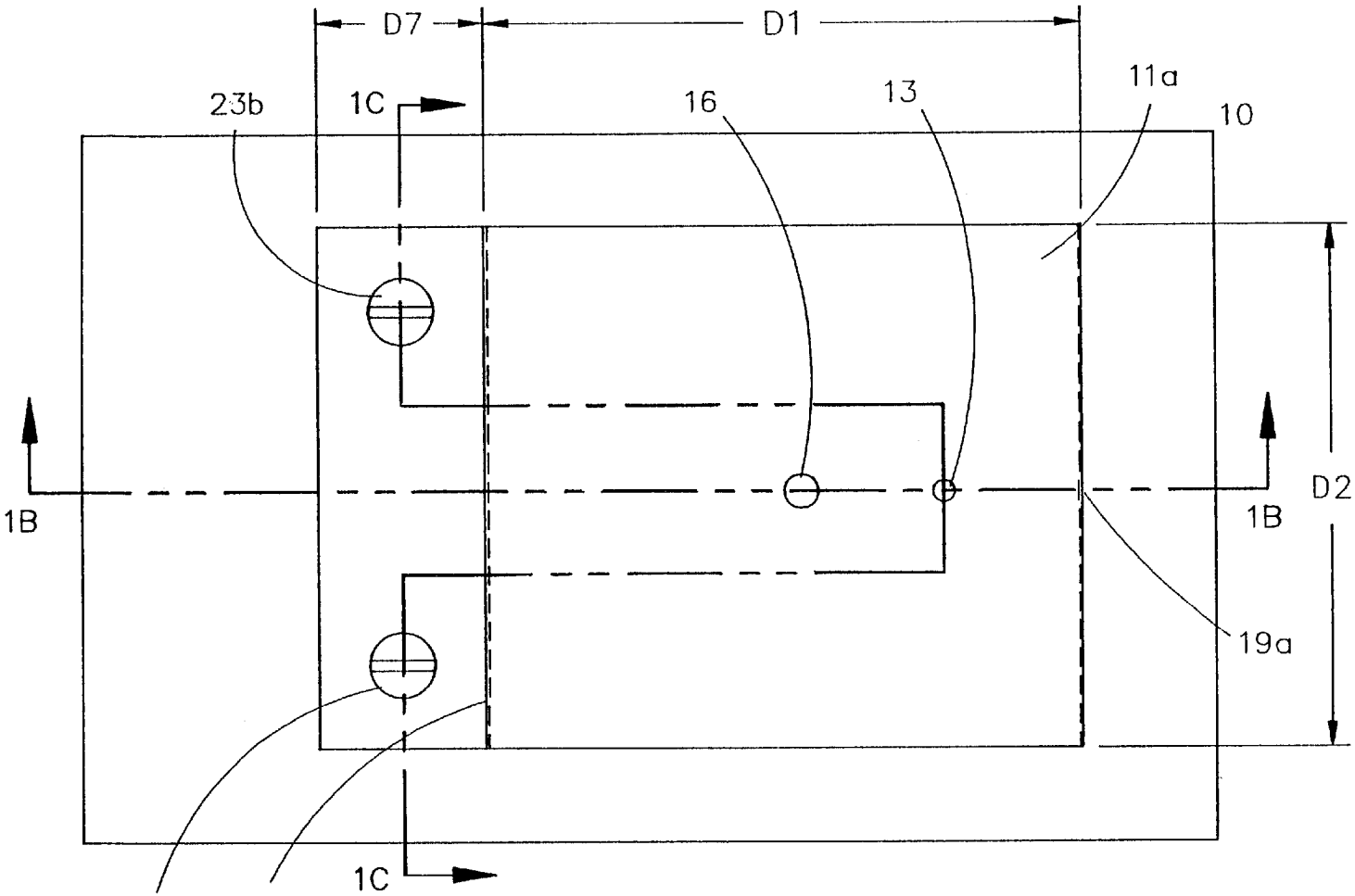
FIG. 1A illustrates a top view of the design configuration of a single feed multi-band PIFA according to the first embodiment of the present invention.

Preferred embodiments of the present invention are now explained while referring to the drawings.

Figure 1B:
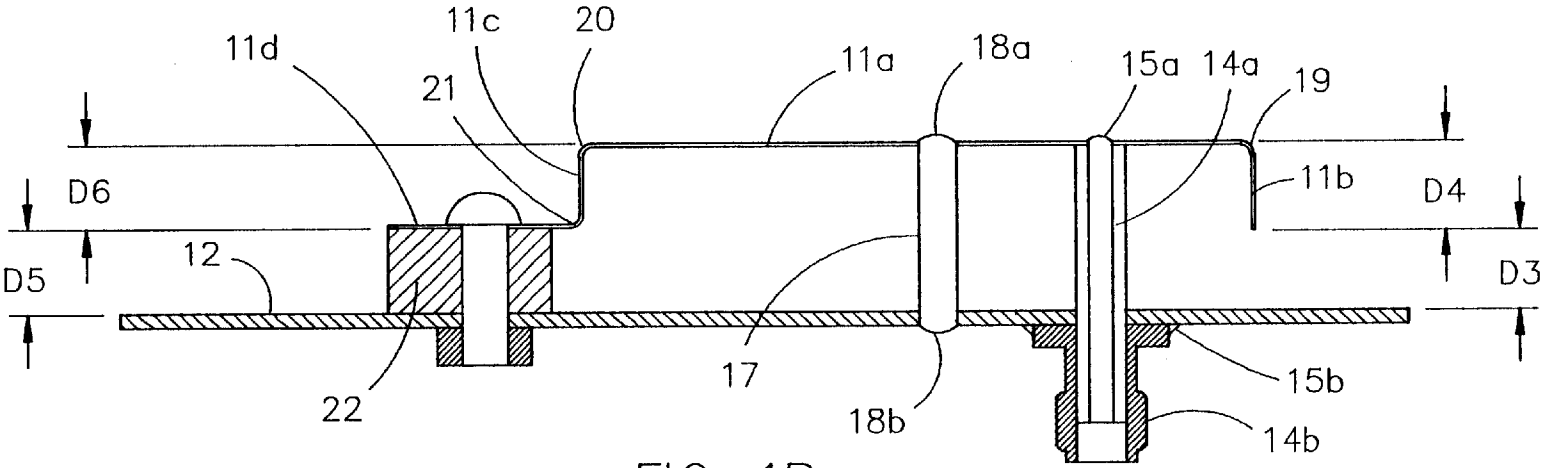
FIG. 1B is a sectional view taken along the line 1B—1B of FIG. 1A.
Figure 1C:
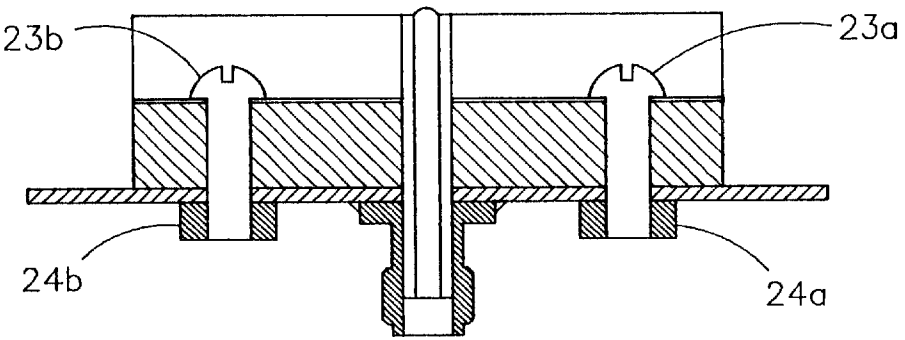
FIG. 1C is a sectional view taken along the line 1C—1C of FIG. 1A.

In the accompanying text describing the single feed multi-band PIFA 10 covered under the first embodiment of this invention, refer to the FIGS. 1A, 1B and 1C for illustrations. The PIFA 10 includes a radiating element 11a that is located above the ground plane 12. A power feed hole 13 is located corresponding to the radiating element 11*a*. A connector feed pin 14*a*, serves as an electrical path for radio frequency (RF) power to the radiating element 11*a* is inserted through the feed hole 13 from the bottom surface of the ground plane 12. The connector feed pin 14*a* is electrically insulated from the ground plane 12 where the feed pin passes through the hole in the ground plane 12. The connector feed pin 14*a* is electrically connected to the radiating element 11*a*at 15*a* with solder. The body of the feed connector 14*b* is electrically connected to the ground plane 12 at 15*b* with solder. The connector feed pin 14*a* is electrically insulated from the body of the feed connector 14*b*. A through hole 16 is located corresponding to the radiating element 11*a*. A conductive post or pin 17, which serves as a short circuit between the radiating element 11*a* and ground plane 12, is inserted through the hole 16. The conductive post 17 is electrically connected to the radiating element 11*a* at 18*a* with solder. The conductive post 17 is also electrically connected to the ground plane 12 at 18*b* with solder. The radiating element 11*a* is bent 90° at 19 along the edge 19*a* to form a right side vertical plane 11*b*. The lower edge of the vertical plane 11*b* is at a specific distance D3 above the ground plane 12. The vertical plane 11*b* serves as a capacitive loading plate for the radiating element 11*a*. The radiating element 11*a* is bent 90° at 20 along the edge 20*a* to form a left side vertical plane 11*c*. The vertical plane 11*c* is again bent 90° at 21 to form a lower horizontal plane 11*d*. The horizontal plane 11*d* of width D7 is at a specific distance D5 above the ground plane. The horizontal plane 11*d* serves a capacitive loading plate for the radiating element 11*a*. A dielectric block 22 of pre-specified dielectric constant is located in the area between the horizontal plane 11*d* and the ground plane 12. The plastic screws 23*a* and 23*b* hold the dielectric block 22 to the horizontal plane 11*d*. The plastic screw nuts 24*a* and 24*b* hold the dielectric block 22 to the ground plane 12.

The PIFA configuration illustrated in FIGS. 1A, 1B and 1C functions as multi-band antenna with a single feed. The dimensions of the radiating element 11*a*, the right side vertical plane 11*b*, the left side vertical plane 11*c*, the lower horizontal plane 11*d*, the dielectric constant of the block 22 and the location of the shorting pin 17 are the prime parameters that control the resonant frequencies of lower and upper bands. The bandwidths at the lower and upper resonant frequency bands of the multi-band PIFA 10 are determined by: the diameter of the connector feed pin 14*a*, the location of the connector feed pin 14*a*, the location of the shorting pin 17 and the diameter of the shorting pin 17. A combination of the radiating element 11*a*, the shorting pin 17, the vertical plane 11*b*, the vertical plane 11*c*, the horizontal plane 11*d* and the dielectric block 22 results in multiple resonant frequencies of the PIFA 10. The resonant frequencies are lower than the resonant frequency of the PIFA with only the radiating element 11*a* alone. The lowering of the resonant frequencies of the PIFA 10 is due to the capacitive loading offered by the right side vertical plane 11*b* and lower horizontal plane 11*d*. Further reduction of the resonant frequency is due to the dielectric loading caused by the dielectric block 22 located in the area between the lower horizontal plane 11*d* and the ground plane 12.

Figure 2:
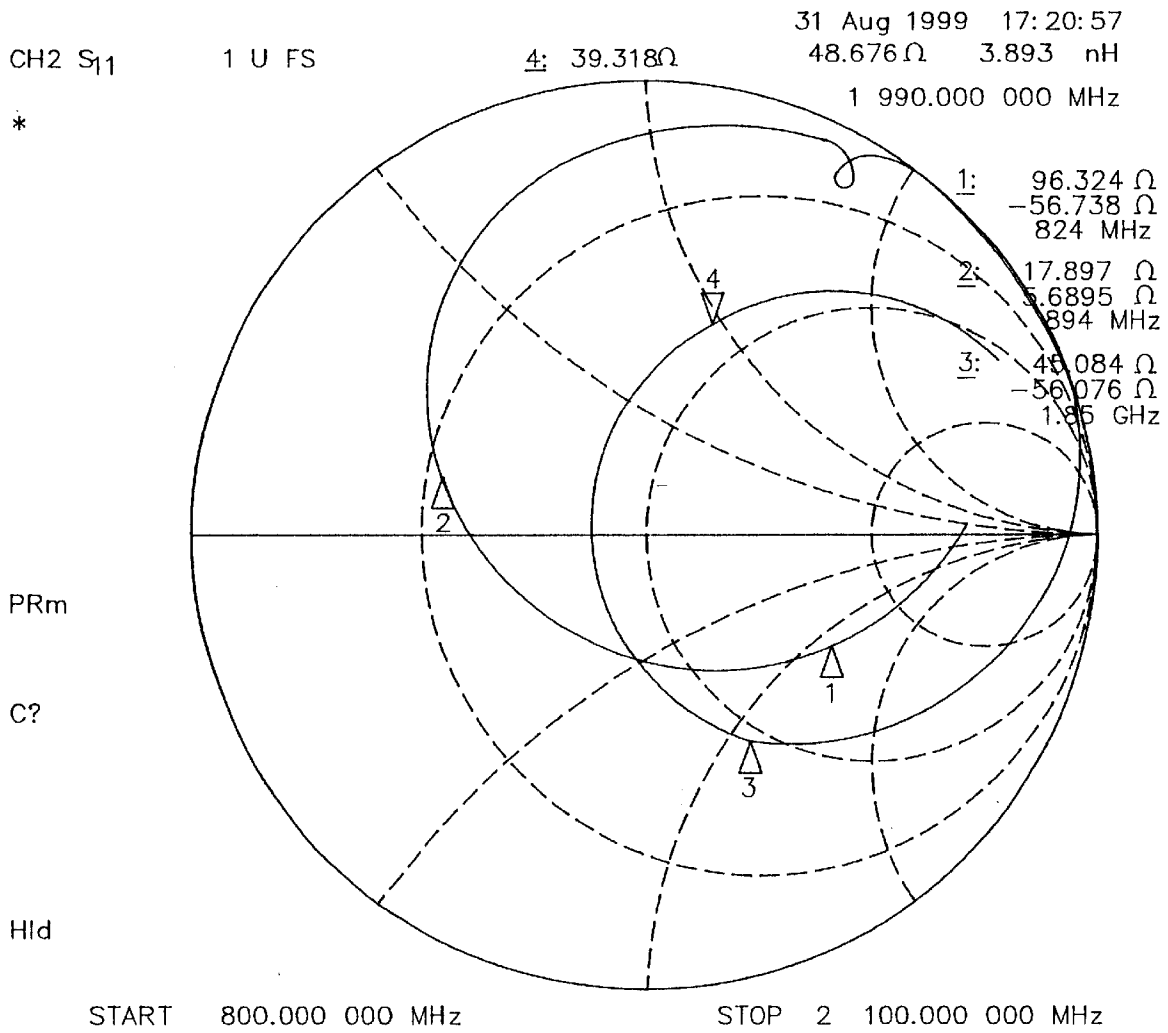
FIG. 2 is a Smith Chart depicting the impedance variation of the multi-band PIFA of FIGS. 1A–1C.
Figure 3:
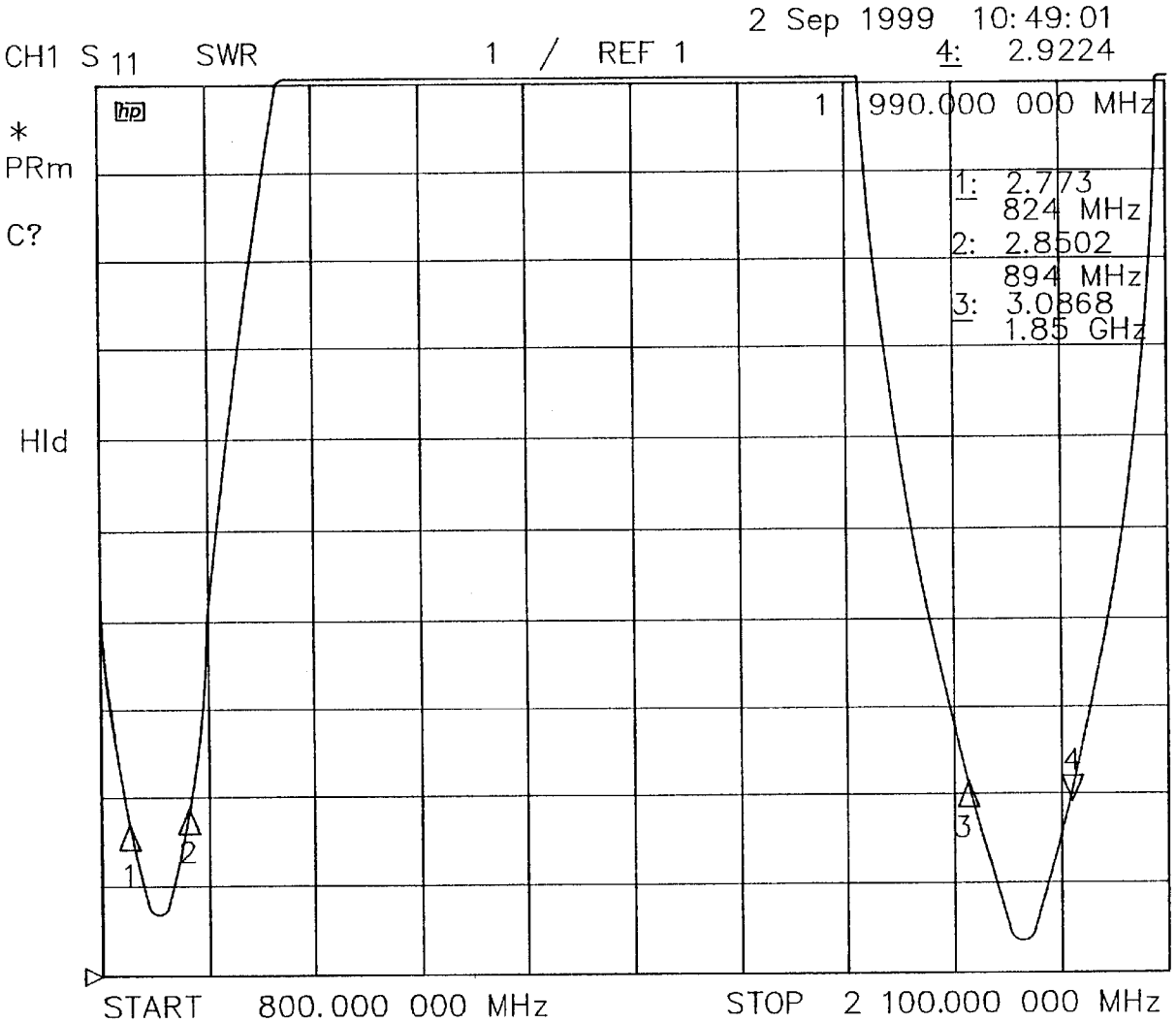
FIG. 3. is a frequency response that depicts the characteristics of the VSWR of the multi-band PIFA of FIGS. 1A–1C.

The results of the tests conducted on the single feed multi-band PIFA 10 illustrated in FIGS. 1A, 1B and 1C referred to as the first embodiment of this invention are shown in FIG. 2 and FIG. 3. FIG. 2 is a Smith Chart of the single feed multi-band PIFA 10 resonating at AMPS (824–894 MHz) and PCS (1850–1990 MHz) bands. FIG. 3 illustrates the VSWR plot of the single feed multi-band PIFA 10 resonating at AMPS and PCS bands. The multi-band impedance match of PIFA 10 has been achieved without use of an external-matching network. The dimensions of the multi-band PIFA 10 are: Length(D1+D7)=41 mm. Width (D2)=31 mm and Height (D5+D6)=9.5 mm. The projected semi-perimeter of the multi-band PIFA 10 is 72 mm as compared to the semi-perimeter of 87.31 mm of a conventional single band PIFA 110 resonating in AMPS band only.

Figure 4A:
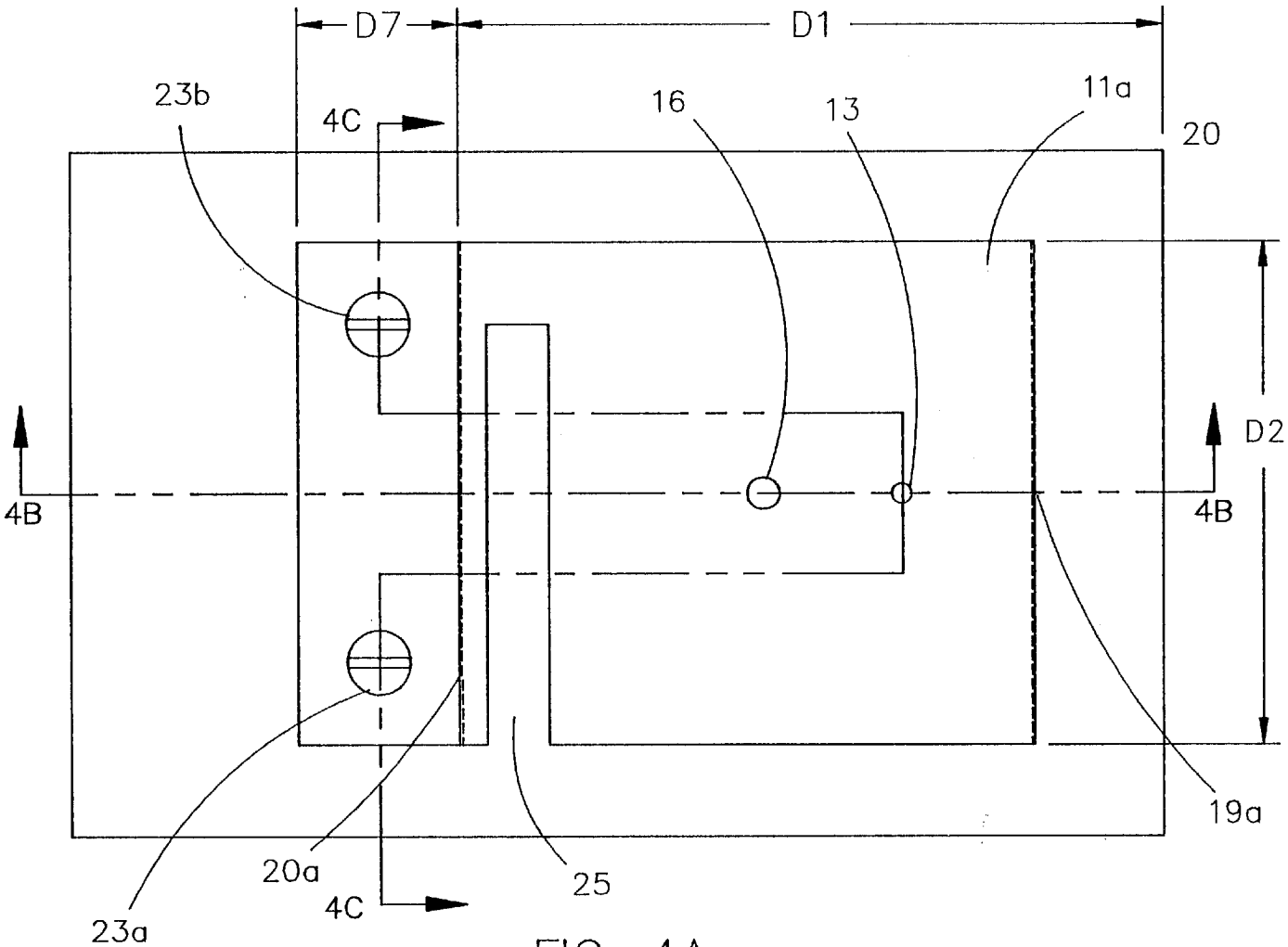
FIG. 4A illustrates a top view of the design configuration of a single feed multi-band PIFA according to the second embodiment of the present invention.
Figure 4B:
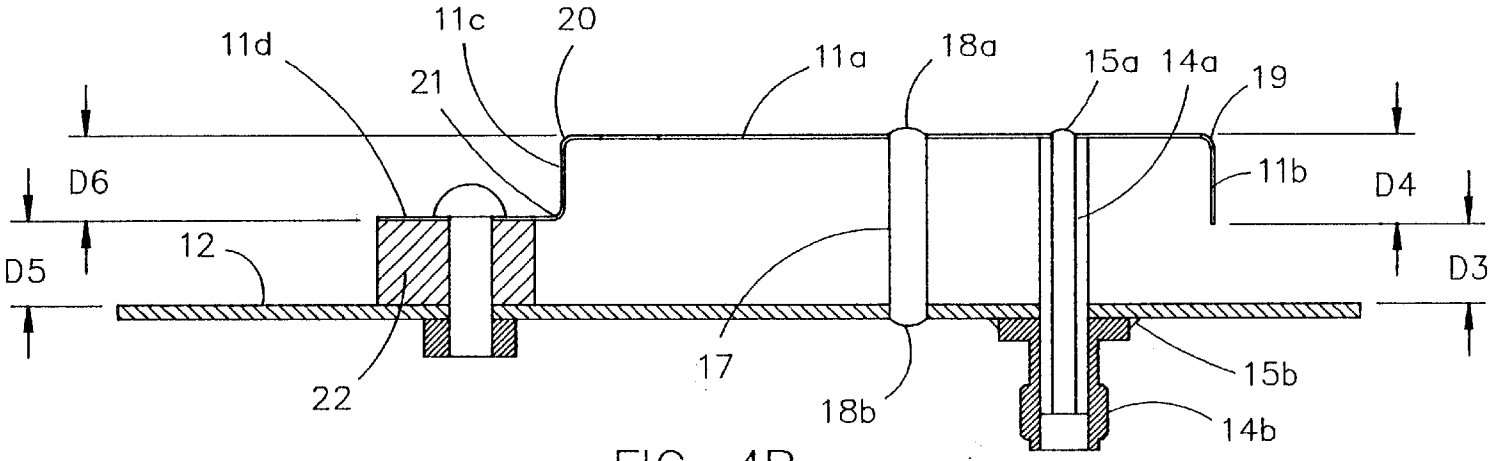
FIG. 4B is a sectional view taken along the line 4B—4B of FIG. 4A.
Figure 4C:
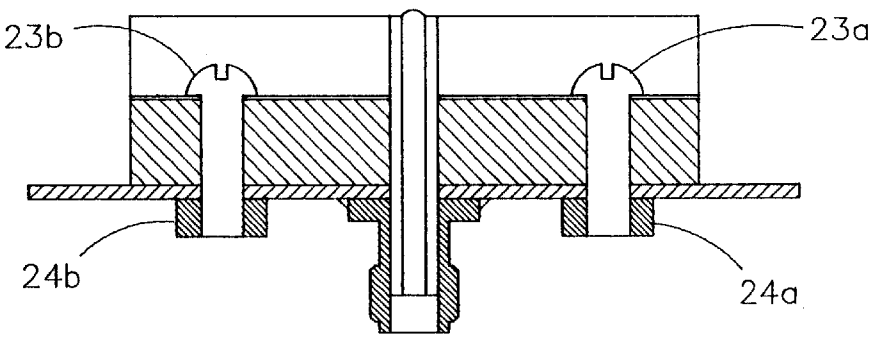
FIG. 4C is a sectional view taken along the line 4C—4C of FIG. 4A.
Figure 5:
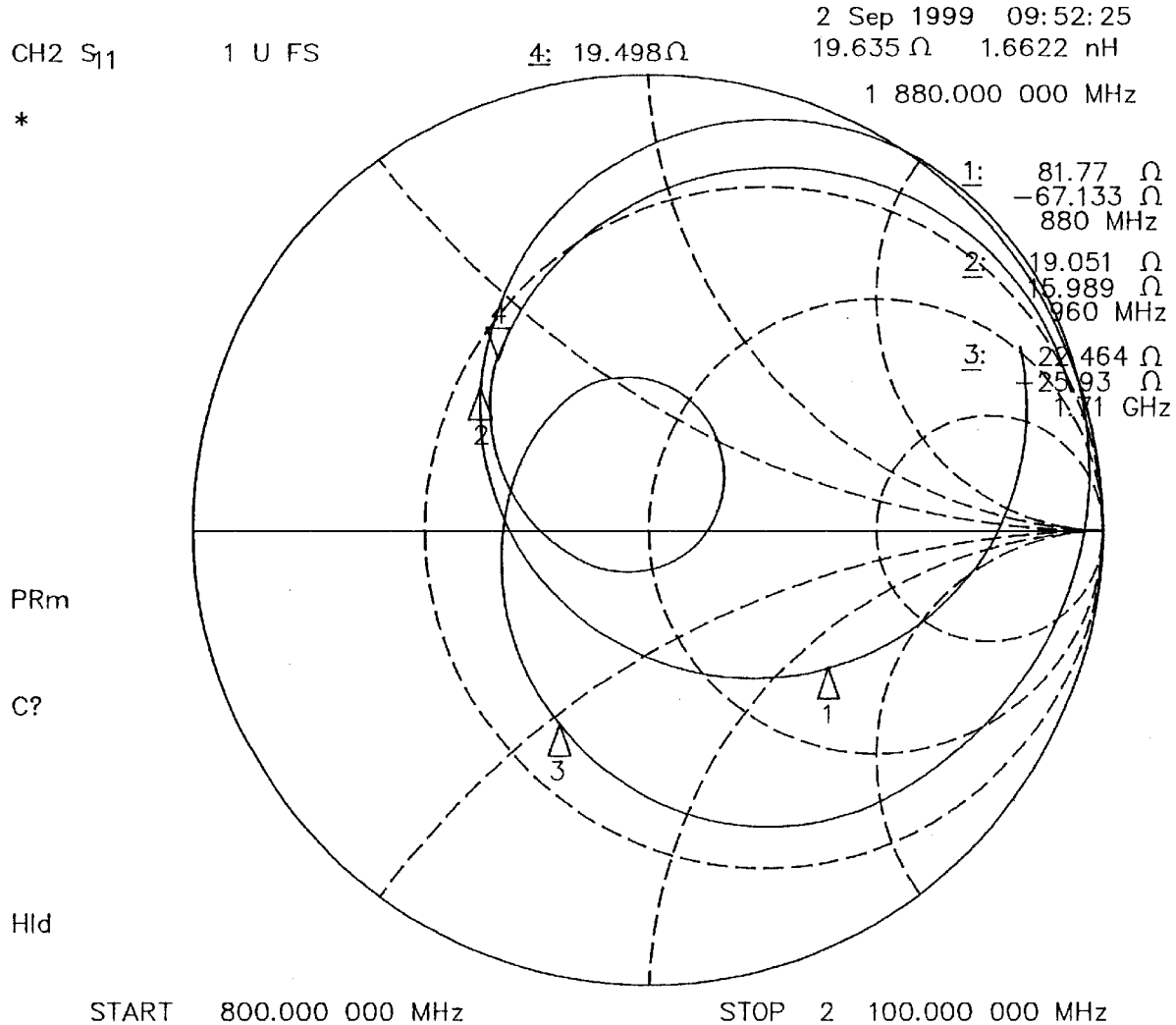
FIG. 5 is a Smith Chart depicting the impedance variation of the multi-band PIFA of FIGS. 4A–4C.
Figure 6:
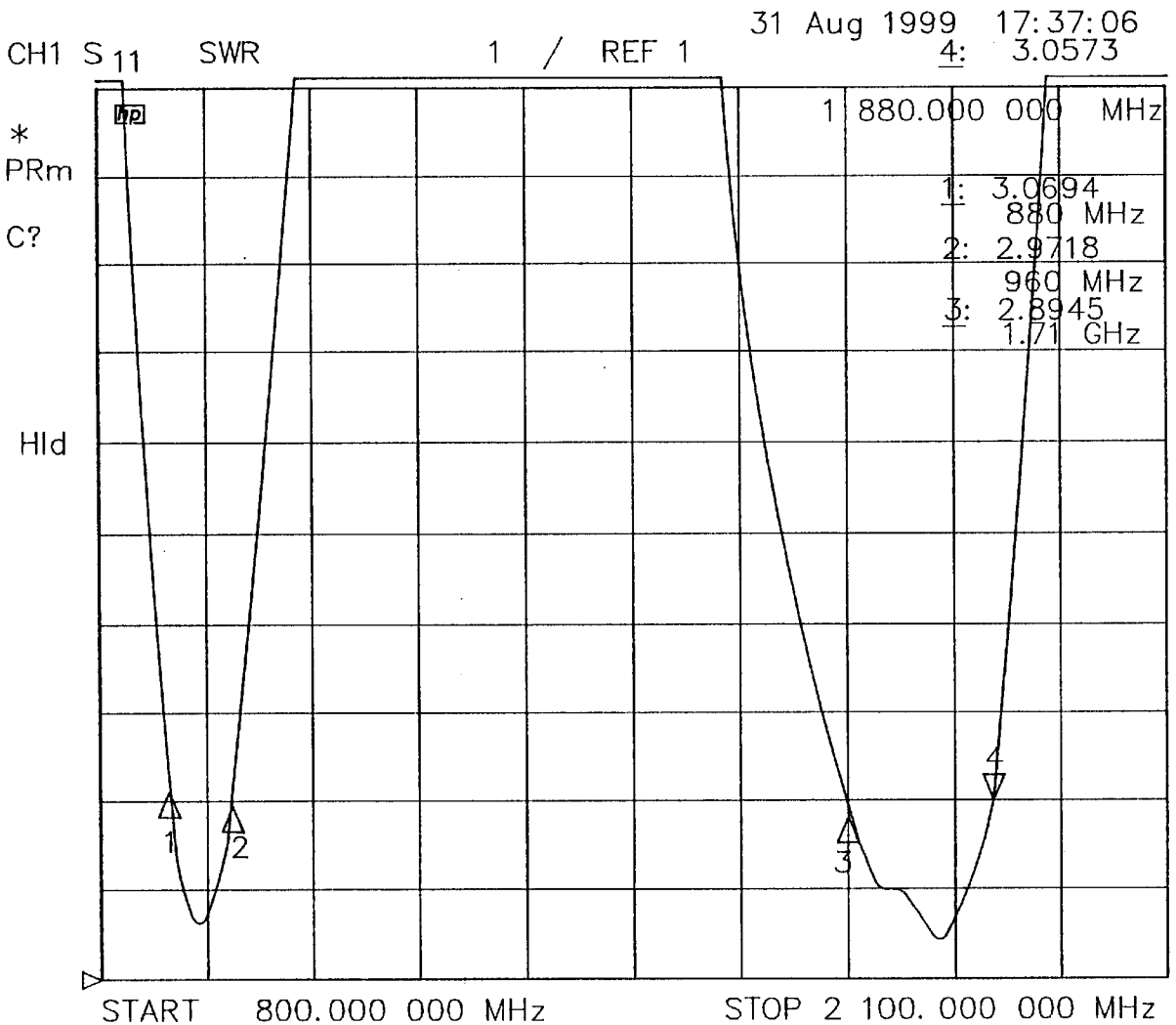
FIG. 6 is a frequency response that depicts the characteristics of the VSWR of the multi-band PIFA of FIGS. 4A–4C.

In the accompanying text describing the single feed multi-band PIFA 20 covered under the second embodiment of this invention, refer to FIGS. 4A, 4B and 4C for illustrations. The multi-band PIFA 20 illustrated in FIGS. 4A, 4B and 4C has an additional slot 25 on the radiating element 11*a*. All the other elements of the multi-band PIFA 20 illustrated in FIGS. 4A, 4B and 4C are identical to the multi-band PIFA 10 illustrated in FIGS. 1A, 1B and 1C which has already been explained while covering the first embodiment of this invention. Further redundant explanation of the single feed multi-band PIFA 20 illustrated in FIGS. 4A, 4B and 4C will therefore be omitted. The slot 25 is positioned in between the left side vertical plane 11*c* and the shorting pin 17 and is located corresponding to a position on the radiating element 11*a* of the multi-band PIFA 20 as illustrated in FIGS. 4A, 4B and 4C. The choice of the location of the slot 25 illustrated in FIGS. 4A, 4B and 4C has been with a specific purpose to offer reactive loading effect to the radiating element 11*a* at the lower resonant band only. Hence, the size and position of the slot 25 will control the resonant frequency of only the lower band of the PIFA 20. The presence of the slot 25 has no effect on the resonant frequency of the upper band of the PIFA 20. The results of the tests conducted on the single feed multi-band PIFA 20 illustrated in FIGS. 4A, 4B and 4C referred to as the second embodiment of this invention are shown in FIG. 5 and FIG. 6. FIG. 5 is a Smith Chart of the single feed multi-band PIFA 20 resonating at GSM (880–960 MHz) and DCS (1710–1880 MHz) bands. FIG. 6 illustrates the VSWR plot of the single feed multi-band PIFA 20 resonating at GSM and DCS bands. The multi-band impedance match of the PIFA 20 has been achieved without use of an external-matching network. The dimensions of the multi-band PIFA 20 are Length (D1+D7)=43.5 mm. Width (D2)=31 mm:and Height (D5+D6)=9 mm. The projected semi perimeter of the multi-band PIFA 20 is 74.5 mm as compared to the semi perimeter of 81.52 mm of a conventional single band PIFA 110 resonating in GSM band only.

Figure 7A:
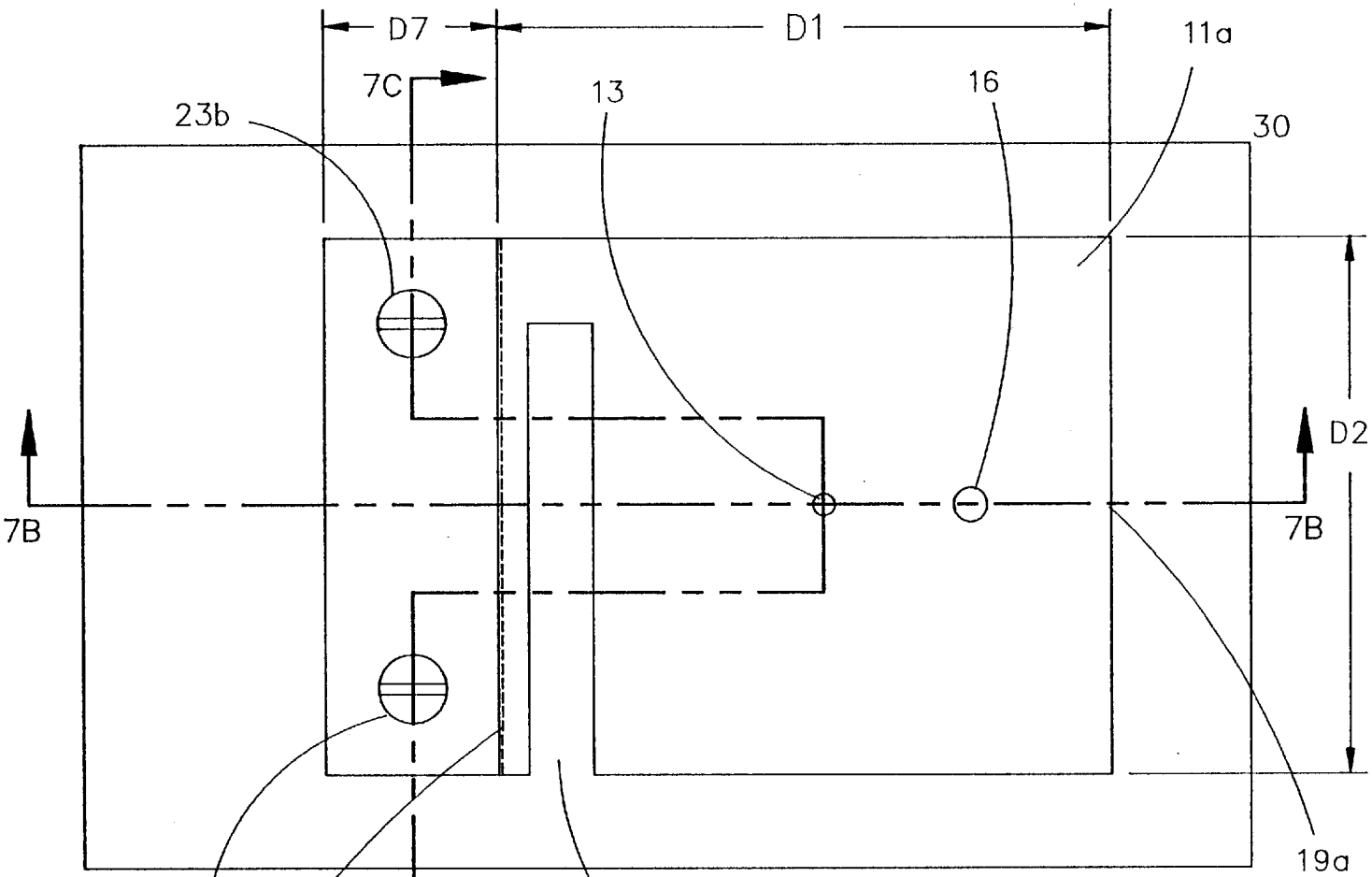
FIG. 7A illustrates a top view of the design configuration of a single band PIFA according to the third embodiment of the present invention.
Figure 7B:
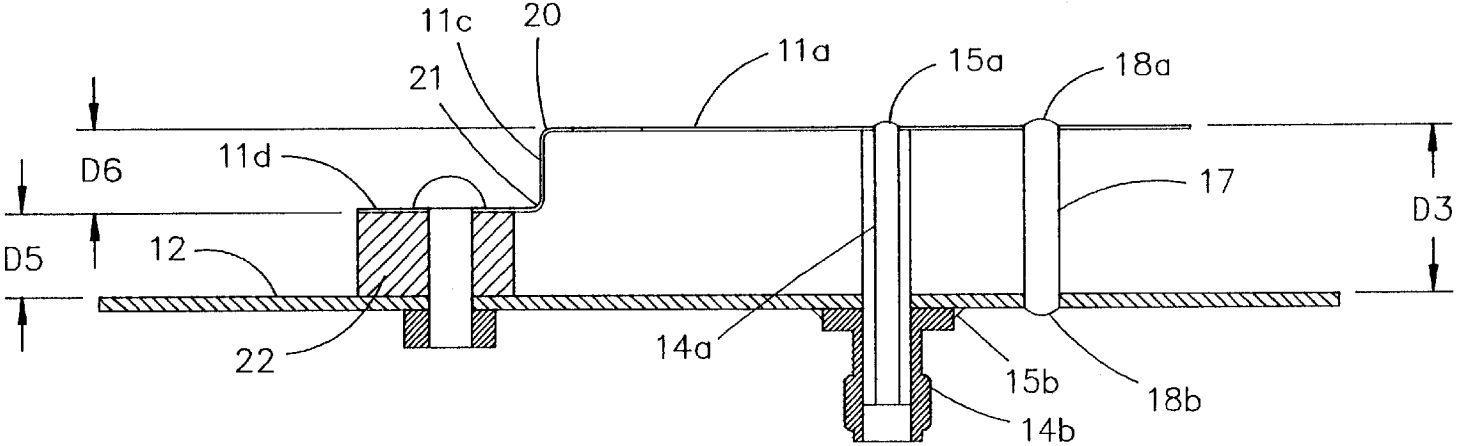
FIG. 7B is a sectional view taken along the line 7B—7B of FIG. 7A.
Figure 7C:
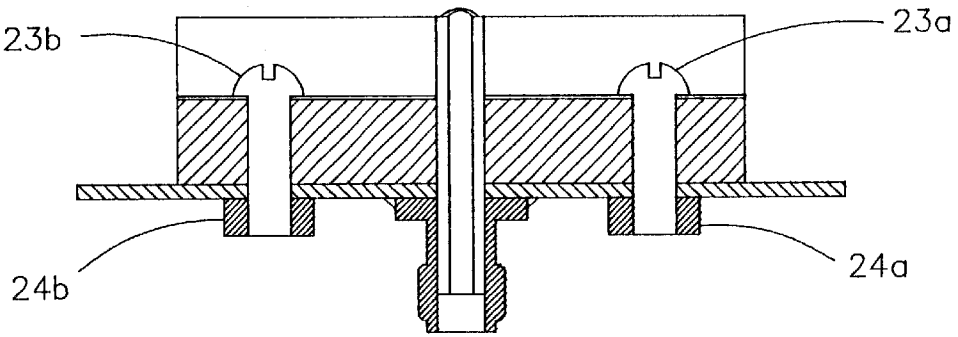
FIG. 7C is a sectional view taken along the line 7C—7C of FIG. 7A.
Figure 8:
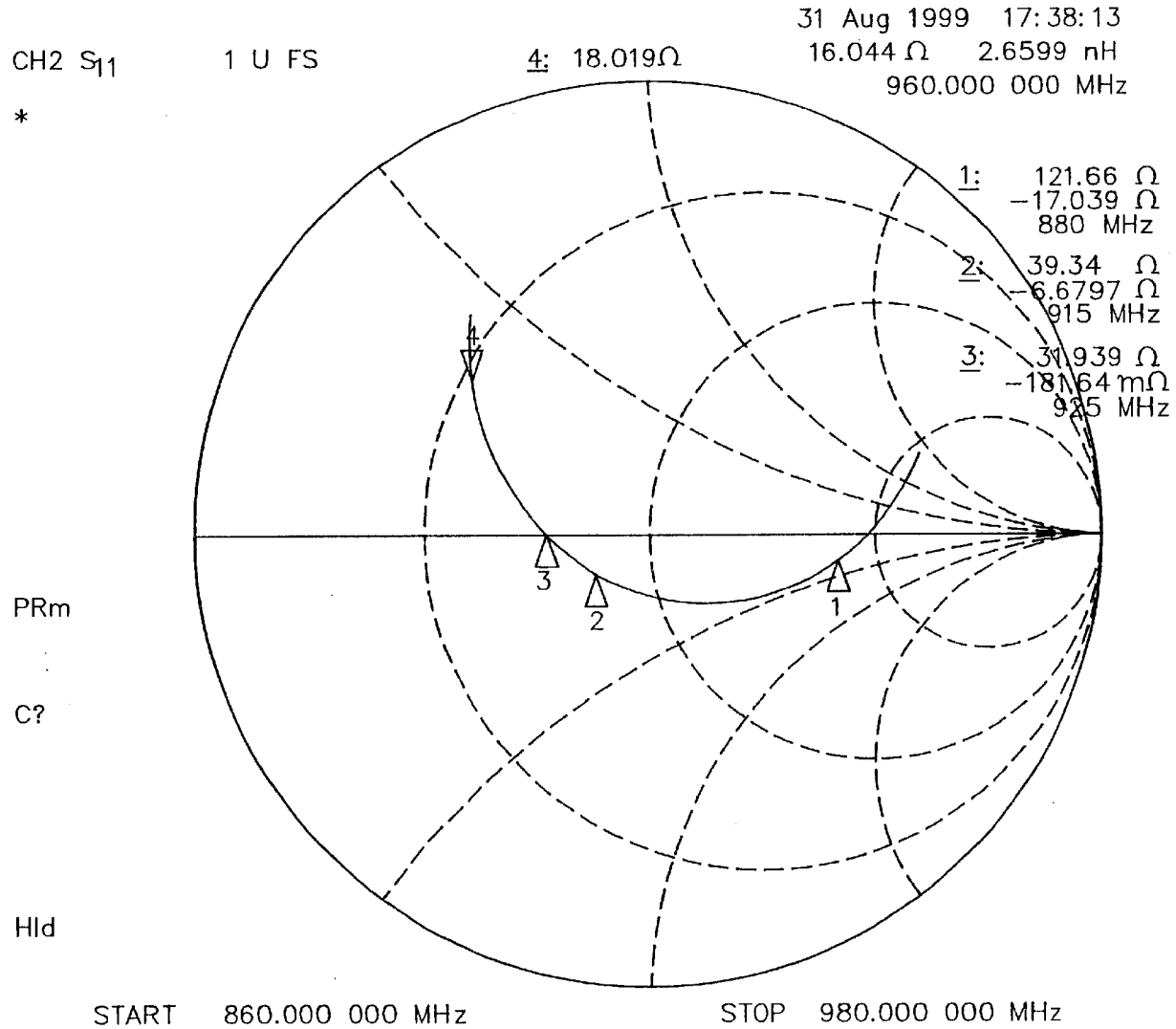
FIG. 8 is a Smith Chart depicting the impedance variation of the single band PIFA of FIGS. 7A–7C.
Figure 9:
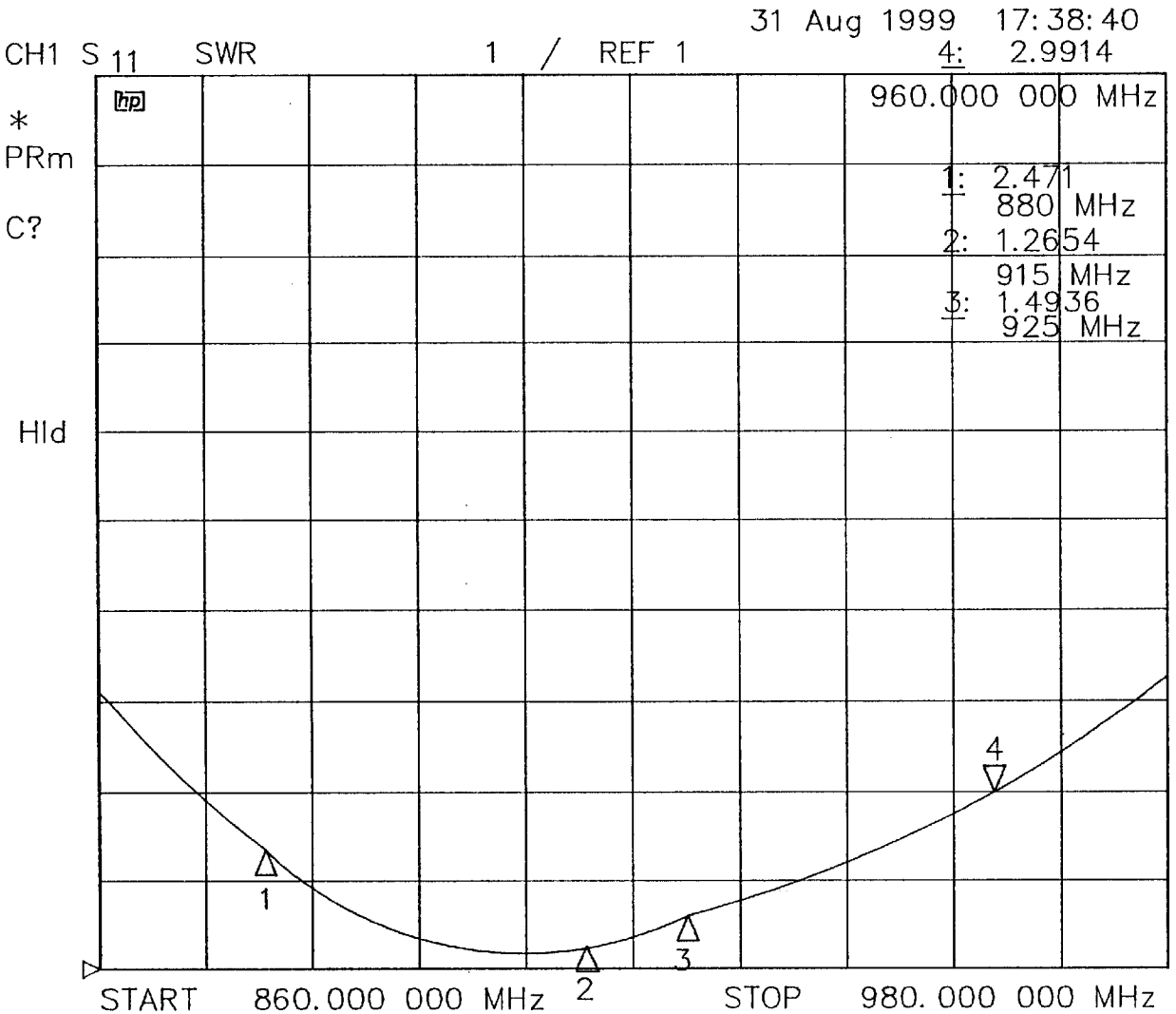
FIG. 9 is a frequency response that depicts the characteristics of the VSWR of the single band PIFA of FIGS. 7A–7C.
Figure 10:
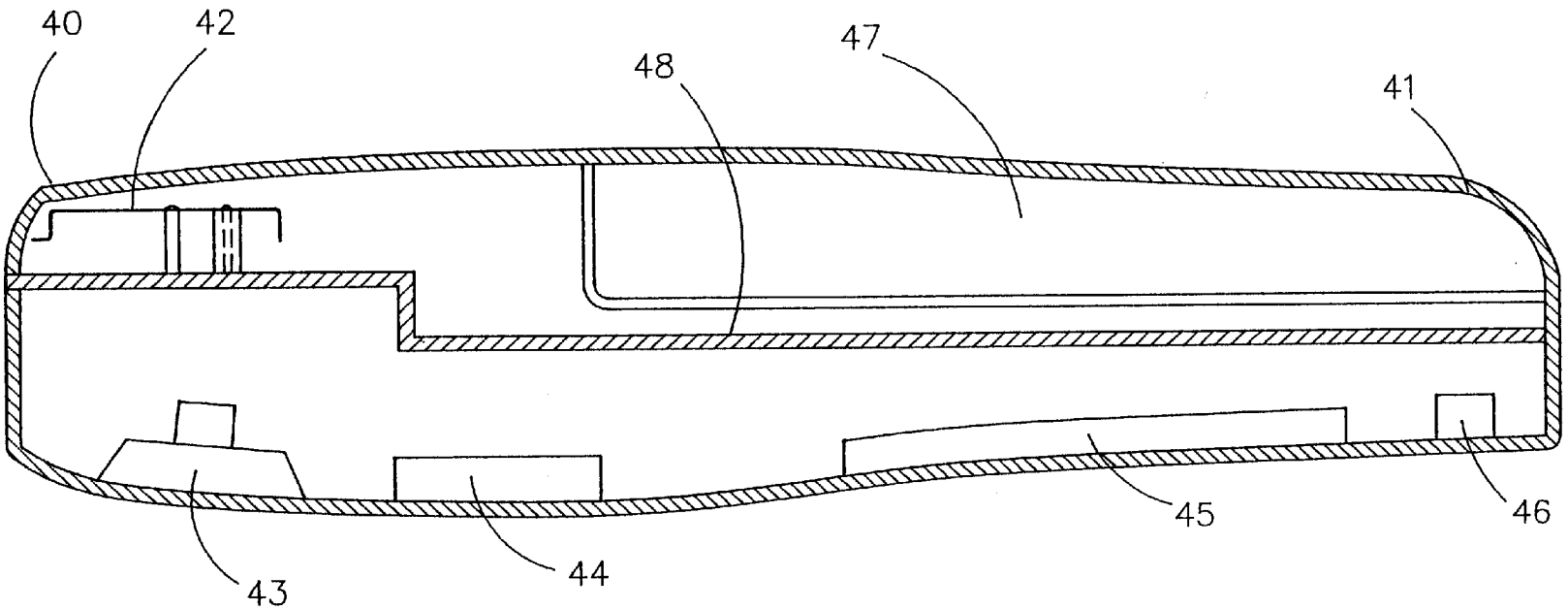
FIG. 10 depicts the typical placement of an internal antenna in a cellular handset.

In the accompanying text describing the miniaturized single band PIFA 30 covered under the third embodiment of this invention, refer to the FIGS. 7A, 7B and 7C for illustrations. The design concepts developed under the first and second embodiments of this invention are equally applicable to the design of miniaturized single band PIFA. The single band PIFA 30 illustrated in FIGS. 7A, 7B and 7c is similar to that of the single feed multi-band PIFA 20 illustrated in FIGS. 4A, 4B and 4C. However, the single band PIFA 30 illustrated in FIGS. 7A, 7B and FIG. 7C does not have a right side vertical plane 11*b*. All the other elements of the single band PIFA 30 illustrated in FIGS. 7A, 7B and 7C are identical to the multi-band PIFA 20 illustrated in FIGS. 4A, 4B and 4C which has already been explained. Therefore, the further description of the single band PIFA 30 illustrated in FIGS. 7A, 7B and 7C has been deleted to avoid the repetition. The results of the tests conducted on the single band PIFA 30 illustrated in FIGS. 7A, 7B and 7C referred to as the third embodiment of this invention are shown in FIG. 8 and FIG. 9. FIG. 8 is a Smith Chart of the single band PIFA 30 resonating at GSM (880–960 MHz) band. FIG. 9 illustrates the VSWR plot of the single band PIFA 30 resonating at GSM band. The single band impedance match of the PIFA 30 has been obtained without use of an external-matching network. The dimensions of the single band PIFA 30 are: Length (D1+D7)=32 mm: Width (D2)=32 mm:Height (D5+D6)=9.0 mm. As can be seen from these dimensions of the PIFA 30, the projected semi perimeter of the miniaturized single band PIFA 30 resonating in GSM band is 64 mm only compared to the corresponding value of 81.52 mm of a conventional GSM band PIFA. So the novel design proposed in this invention to achieve the miniaturization of the size of the PIFA in cellular frequency band has been demonstrated.

Figure 11A:
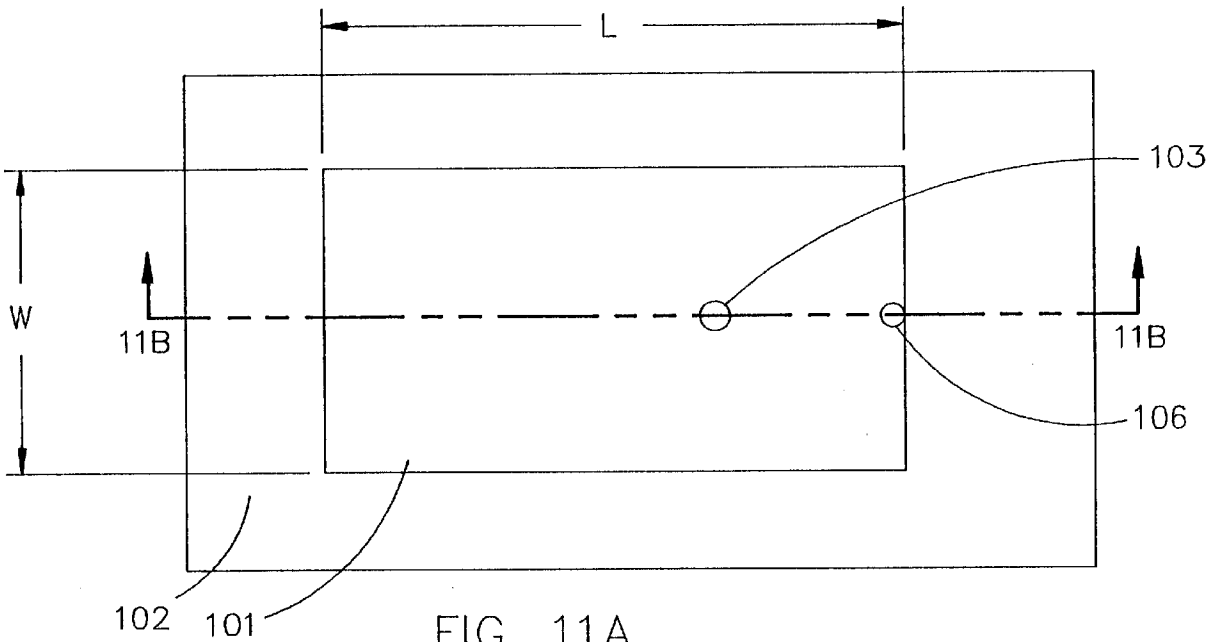
FIG. 11A is a top view of a prior art single band PIFA.
Figure 11B:
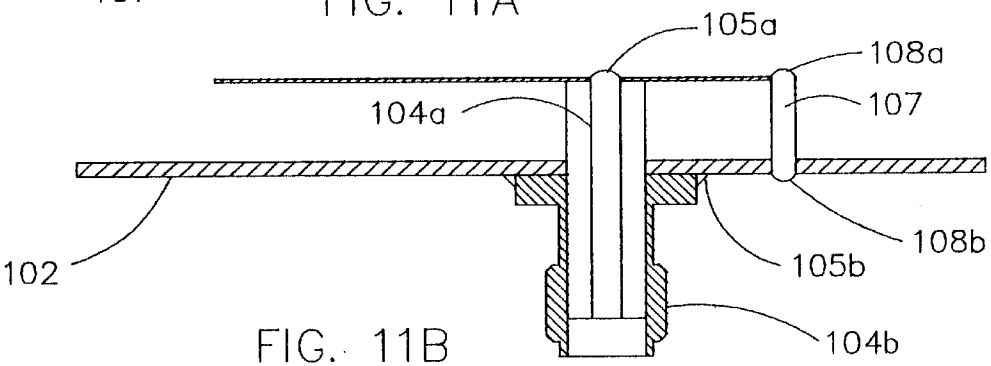
FIG. 11B is a sectional view taken along the line 11B—11B of FIG. 11A.
Figure 12A:
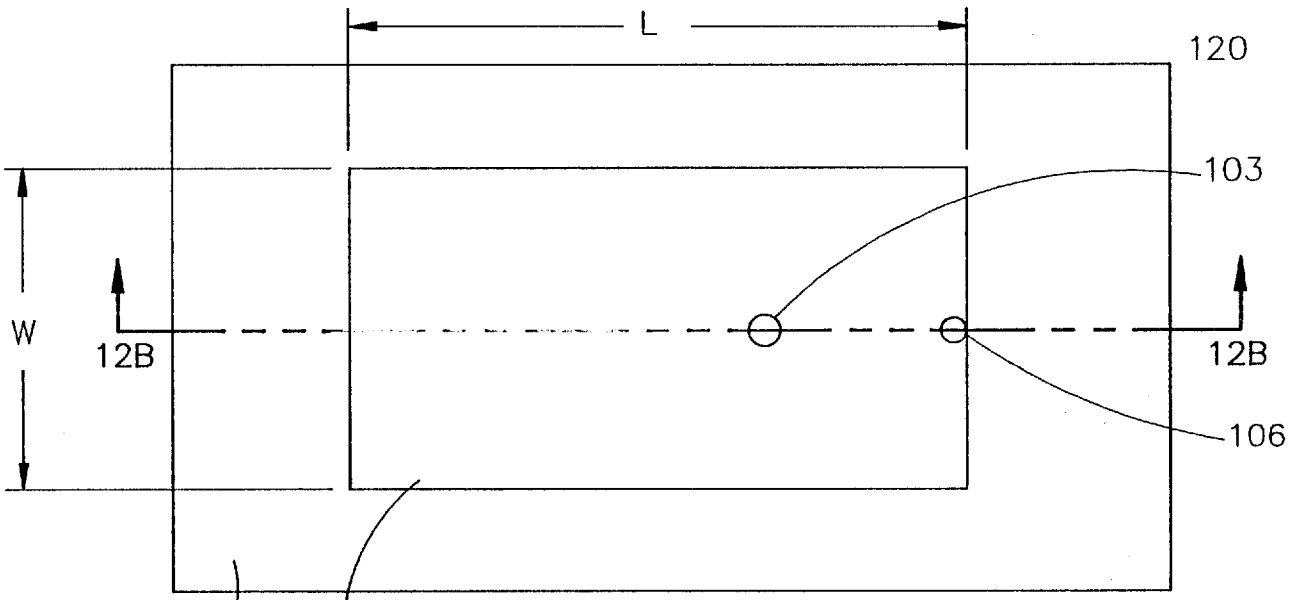
FIG. 12A is a top view of a prior art single band PIFA with capacitive loading element.
Figure 12B:
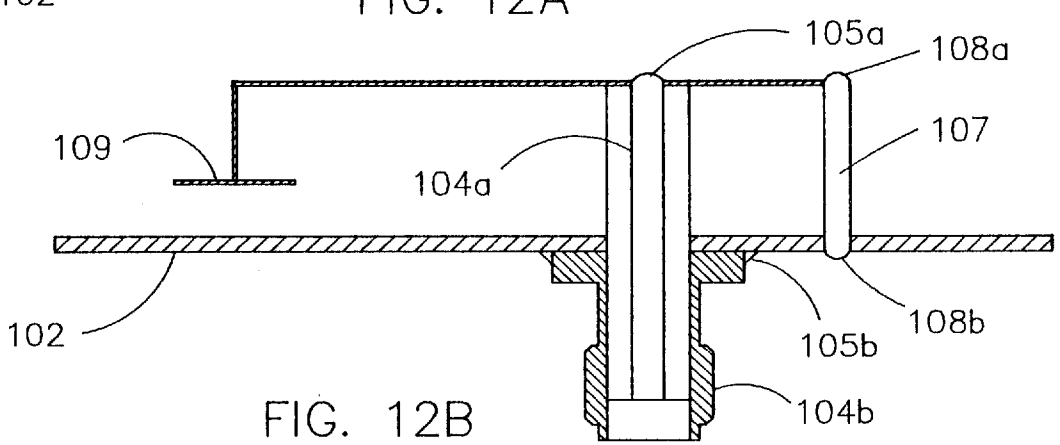
FIG. 12B is a sectional view taken along the line 12B—12B of FIG. 12A.
Figure 13A:
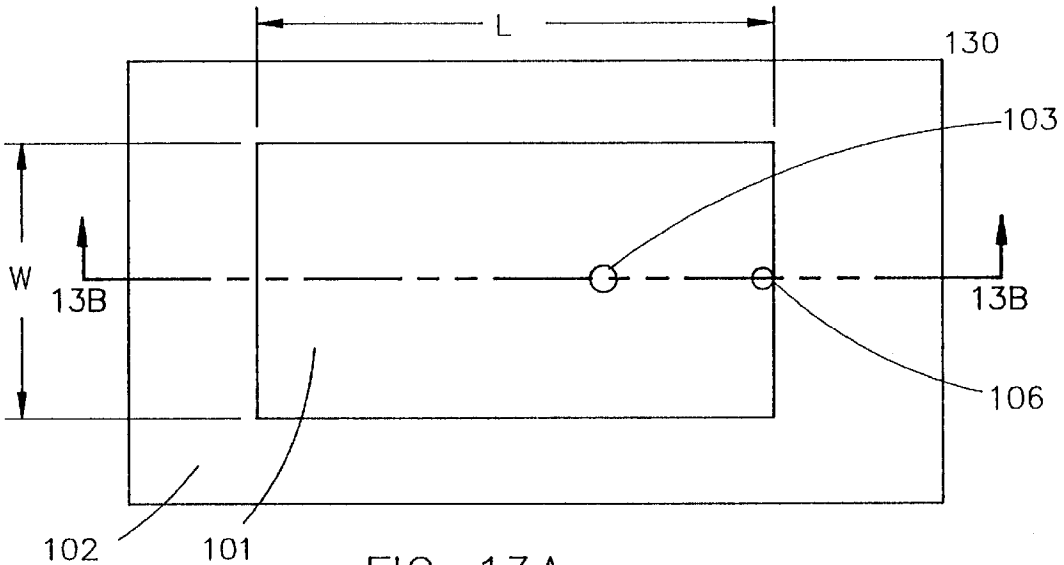
FIG. 13A is a top view of a prior art single band PIFA with dielectric loading.
Figure 13B:
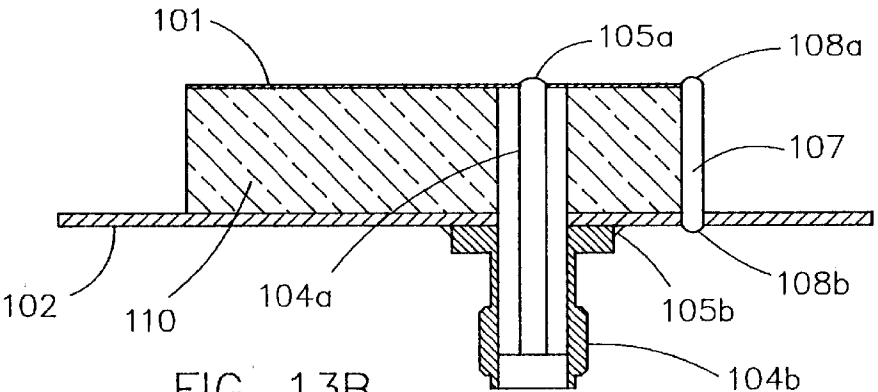
FIG. 13B is a sectional view taken along the line 13B—13B of FIG. 13A.
Figure 14A:
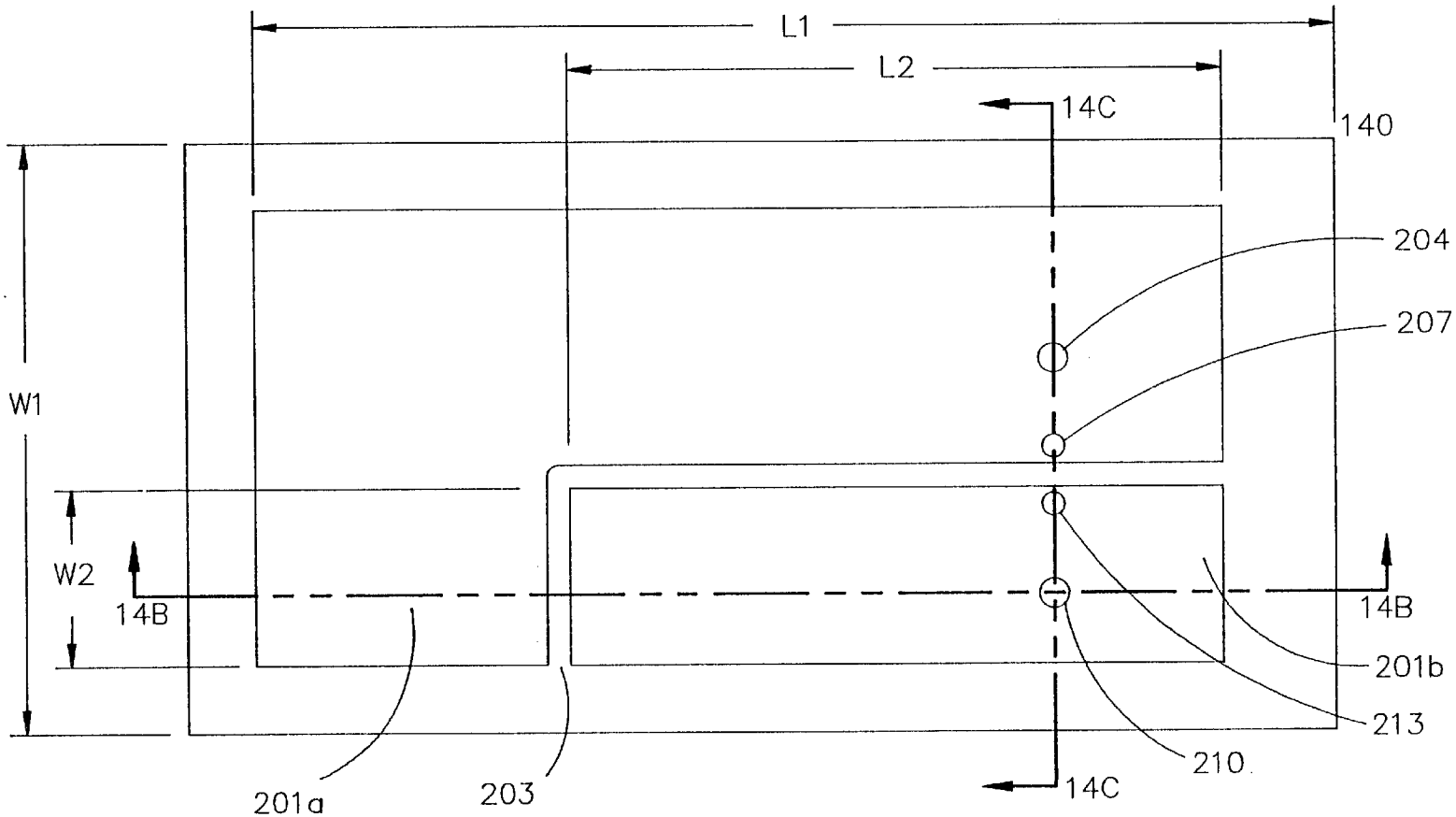
FIG. 14A is a top view of a prior art multi-band PIFA with separate feeds.
Figure 14B:
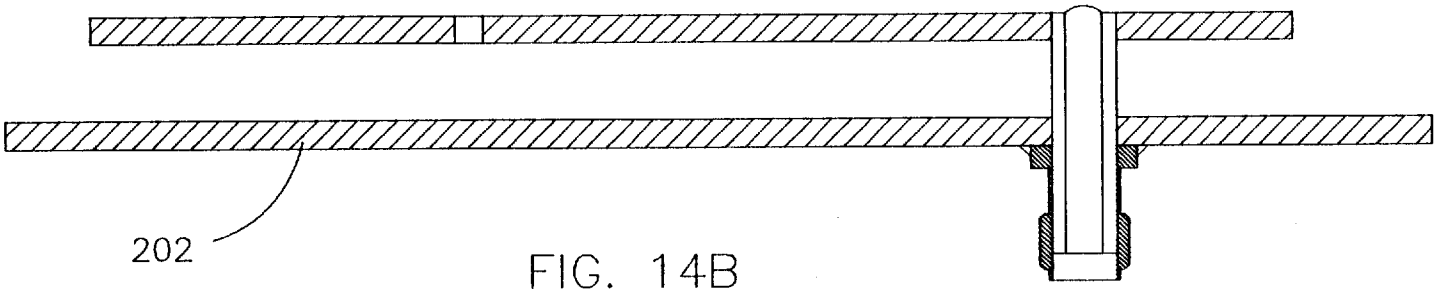
FIG. 14B is a sectional view taken along the line 14B—14B of FIG. 14A.
Figure 14C:
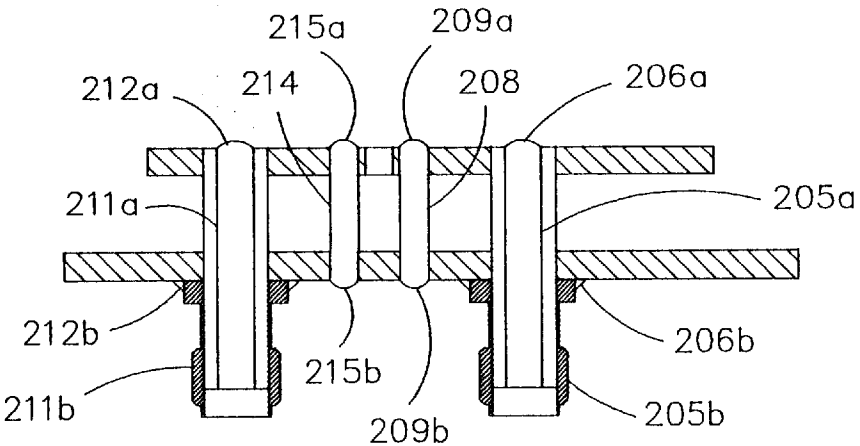
FIG. 14C is a sectional view taken along the line 14C—14C of FIG. 14A.
Figures 15A, 15B:
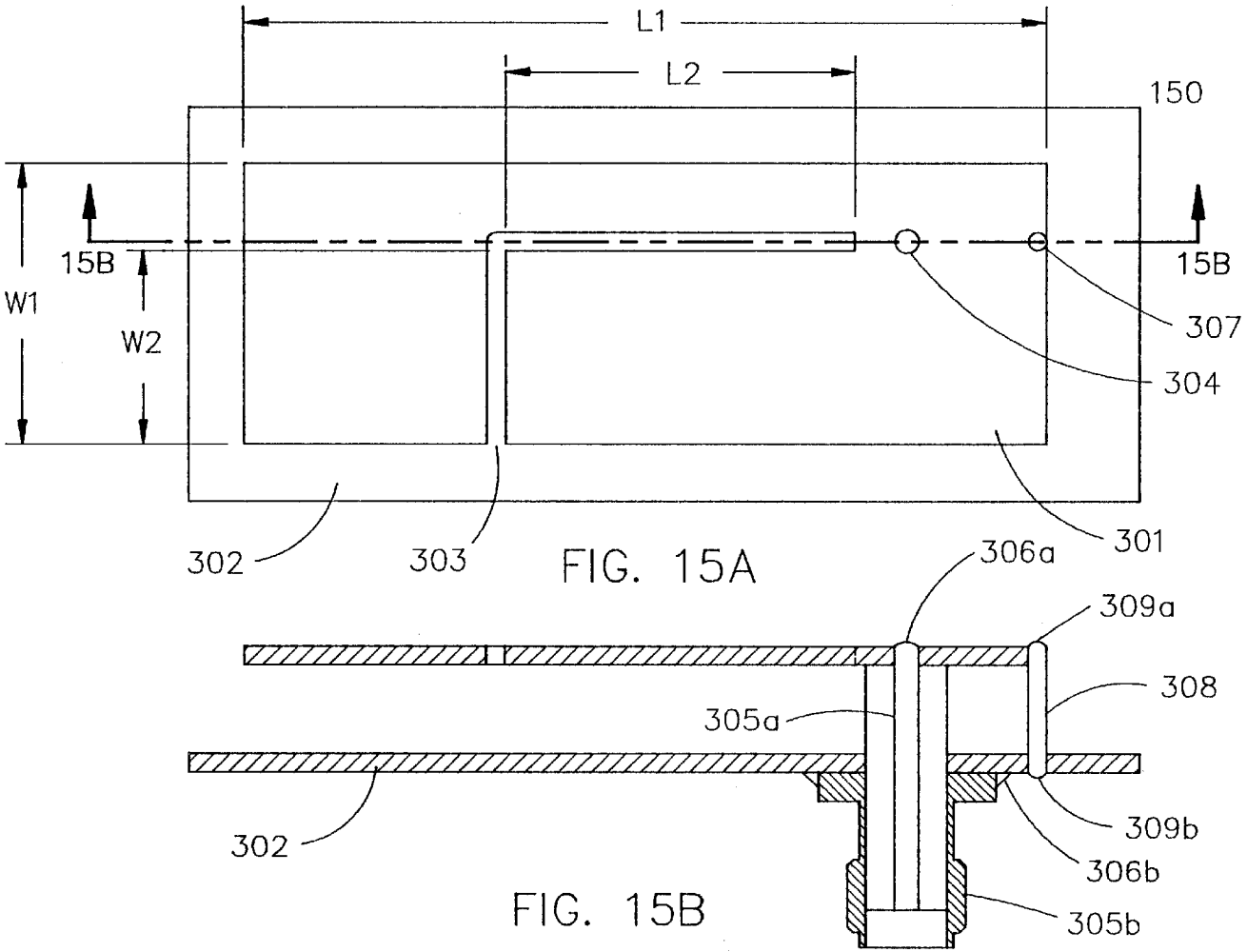
FIG. 15A is a top view of a prior art multi-band PIFA with single feed.
FIG. 15B a sectional view taken along the line 15B—15B of FIG. 15A.

With reference to prior art FIGS. 11, A–B, 12A–B, 13A–B, 14A–C and 15A–B, it is seen that in all cases one edge of the radiating element of the PIFA is shorted to the ground plane element. Thus, inherently this shorted edge of the radiating element is a non-radiating edge.

However in the construction and arrangement of the present invention, and as shown in FIGS. 1A–C, 4A–C, and 7A–C, no edge of the radiating element is shorted, thus inherently all four edges of the radiating element are radiating edges. In addition, PIFAs constructed and arranged in accordance with the invention provide a radiating element as a geometric shape (for example a rectangle) that is symmetrically about a centerline of the radiating element, and the PIFA's shorting pin and single feed pin are spaced from each other and are located along this centerline.

FIGS. 1A–C show a single-feed, multi-band, PIFA in accordance with the invention wherein the radiating element is a continuous metal member having no slot therein, with the feed pin located adjacent to a first radiating edge of the radiating element, and with the shorting pin located on the opposite side of the feed pin.

FIGS. 4A–C show a single-feed, multi-band, PIFA in accordance with the invention wherein the radiating element contains a slot, with the feed pin located adjacent to a first radiating edge of the radiating element, with the shorting pin located on the opposite side of the feed pin, and with the radiating element including a slot that is located between the shorting pin and a radiating edge that is opposite to the first radiating edge, the slot being a generally linear slot having an open end that is locating on a third radiating edge, and the slot extending into the radiating element generally perpendicular to the centerline of the radiating element.

FIGS. 7A–C show a single-feed, single-band, PIFA in accordance with the invention wherein the radiating element contains a slot, with the shorting pin located adjacent to a first radiating edge of the radiating element, with the feed pin located on the opposite side of the shorting pin, and with the radiating element including a slot that is located between the feed pin and a radiating edge that is opposite to the first radiating edge, the slot being a generally linear slot having an open end that is locating on a third radiating edge, the slot extending into the radiating element generally perpendicular to the centerline of the radiating element.

Thus the novel design technique of single feed multi-band PIFA and single band PIFA of this invention has accomplished at least all of its stated objectives.

We claim:

1. A single-feed PIFA, comprising:

a metal ground plane element;

a metal radiating element;

the radiating element being spaced from the ground plane element and extending generally parallel thereto;

the radiating element having a geometric shape that is symmetrical about a centerline, the geometric shape of the radiating element defining a radiating outer edge, one end of the centerline intersecting the outer edge at a first point, and an opposite end of the centerline intersecting the outer edge at a second point;

a metal shorting pin electrically connecting the radiating element to the ground plane element, the shorting pin being located on the centerline of the radiating element at a first position that is spaced from the radiating outer edge of the radiating element; and a metal feed pin electrically connected to the radiating element, the feed pin being spaced from the shorting pin and located on the centerline of the radiating element at a second position that is spaced from the radiating outer edge of the radiating element.

2. The PIFA of claim 1 wherein the geometric shape is a rectangle having a first width-edge, a second width-edge, and two length-edges that extend between the first and second width-edges.

3. The PIFA of claim 1 wherein the ground plane element and the radiating element are planar elements.

4. A single-feed, multi-band, PIFA in accordance with claim 3 wherein the radiating element is devoid of an open slot.

5. A single-feed, multi-band, PIFA in accordance with claim 3 wherein the feed pin is spaced from the first point on the radiating edge of the radiating element, wherein the shorting pin is located between the feed pin and the second point on the radiating edge of the radiating element, and wherein the radiating element includes a slot that is located between the shorting pin and the second point on the radiating edge of the radiating element.

6. A single-feed, single-band, PIFA in accordance with claim 3 wherein the shorting pin is spaced from the first point on the radiating edge of the radiating element, wherein the feed pin is located between the shorting pin and the second point on the radiating edge of the radiating element, and wherein the radiating element includes a slot that is located between the feed pin and the second point on the radiating edge.

7. A single-feed PIFA, comprising:

a metal ground plane element;

a generally rectangular-shaped metal radiating element having four radiating edges;

the radiating element being spaced from the ground plane element and extending generally parallel thereto;

the radiating element having a first radiating width-edge, a second radiating width-edge, two radiating length-edges that extend between the first and second radiating width-edges, and a centerline that extends between the first radiating width-edge and the second radiating width-edge and is generally centered between the two radiating length-edges;

a metal shorting pin electrically connecting the radiating element to the ground plane element, located on the centerline of the radiating element at a first position that is spaced from the first and second radiating width-edges; and a metal feed pin electrically connected to the radiating element, spaced from the shorting pin and located on the centerline of the radiating element at a second position that is spaced from the first and second radiating width-edges.

8. The PIFA of claim 7 wherein the ground plane element and the radiating element are planar elements.

9. The PIFA of claim 8 including:

a metal capacitive loading plate extending from the first width-edge in a direction toward the ground plane element without physically contacting the ground plane element.

10. The PIFA of claim 9 wherein the radiating element is devoid of an open slot.

11. The PIFA of claim 8 including:

a metal extending-plate extending from the second width-edge in a direction toward the ground plane element without physically contacting the ground plane element;

a metal capacitive loading plate extending from the extending-plate in a direction generally parallel to the ground plane element, spaced from the ground plane element and generally parallel to the ground plane element;

a dielectric block located intermediate the capacitive loading plate and the ground plane element; and mounting means associated with the capacitive loading plate, the dielectric block and the ground plane element joining the radiating element, the dielectric block and the ground plane element as a unitary PIFA assembly.

12. The PIFA of claim 11 wherein the radiating element is devoid of an open slot.

13. The PIFA of claim 7 wherein the ground plane element and the radiating element are both planar elements, including a first metal capacitive loading plate extending from the first width-edge in a direction toward the ground plane element without physically contacting the ground plane element;

a metal extending-plate extending from the second width-edge in a direction toward the ground plane element without physically contacting the ground plane element;

a second metal capacitive loading plate extending from the extending-plate in a direction generally parallel to the ground plane element, spaced from the ground plane element and generally parallel to the ground plane element;

a dielectric block located intermediate the second capacitive loading plate and the ground plane element; and mounting means associated with the second capacitive loading plate, the dielectric block, and the ground plane element for joining the radiating element, the dielectric block, and the ground plane element as a unitary PIFA assembly.

14. The PIFA of claim 13 wherein the radiating element is devoid of an open slot.

15. A single-feed, multi-band, PIFA, comprising:

a metal ground plane element;

a generally rectangular-shaped metal radiating element having four radiating edges;

the radiating element being spaced from the ground plane element and extending generally parallel thereto;

the radiating element having a first and a second radiating edge that are generally parallel, a third and a fourth radiating edge that are generally parallel and extend between the first and second radiating edges, and a centerline that extends between the first and a second radiating edges and is generally centered between the third and fourth radiating edges;

a metal feed pin electrically connected to the radiating element and located on the centerline of the radiating element at a position that is spaced from the first radiating edge;

a metal shorting pin electrically connecting the radiating element to the ground plane element, located on the centerline of the radiating element at a position that is spaced from the second radiating edge and between the second radiating edge and the feed pin; and an open slot extending into the radiating element from the third radiating edge, at a position that is intermediate the shorting pin and the second radiating edge.

16. The PIFA of claim 15 wherein the ground plane element and the radiating element are planar elements.

17. The PIFA of claim 16 including:

a metal capacitive loading plate extending from the first radiating edge in a direction toward the ground plane element without physically contacting the ground plane element.

18. The PIFA of claim 16 including:

a metal extending-plate extending from the second radiating edge in a direction toward the ground plane element without physically contacting the ground plane element;

a metal capacitive loading plate extending from the extending-plate in a direction generally parallel to the ground plane element, spaced from the ground plane element and generally parallel to the ground plane element;

a dielectric block located intermediate the capacitive loading plate and the ground plane element; and mounting means associated with the capacitive loading plate, the dielectric block, and the ground plane element joining the radiating element, the dielectric block and the ground plane element as a unitary PIFA assembly.

19. The PIFA of claim 15 wherein the ground plane element and the radiating element are both planar elements, including a first metal capacitive loading plate extending from the first radiating edge in a direction toward the ground plane element without physically contacting the ground plane element;

a metal extending-plate extending from the second radiating edge in a direction toward the ground plane element without physically contacting the ground plane element;

a second metal capacitive loading plate extending from the extending-plate in a direction generally parallel to the ground plane element, spaced from the ground plane element and generally parallel to the ground plane element;

a dielectric block located intermediate the second capacitive loading plate and the ground plane element; and mounting means associated with the second capacitive loading plate, the dielectric block, and the ground plane element for joining the radiating element, the dielectric block, and the ground plane element as a unitary PIFA assembly.

20. A single-feed, single-band, PIFA, comprising:

a metal ground plane element;

a generally rectangular-shaped and metal radiating element having four radiating edges;

the radiating element being spaced from the ground plane element and extending generally parallel thereto;

the radiating element having a first radiating width-edge, a second radiating width-edge, two radiating length-edges that extend between the first and second radiating width-edges, and a centerline that extends between the first radiating width-edge and the second radiating width-edge, and is generally centered between the two radiating length-edges;

a metal shorting pin electrically connecting the radiating element to the ground plane element, located on the centerline of the radiating element at a position that is spaced from the first radiating width-edge;

a metal feed pin electrically connected to the radiating element, located on the centerline of the radiating element at a position that is intermediate the position of the shorting pin and the second radiating width-edge and is spaced from the second radiating width-edge; and an open slot extending into the radiating element from a length-edge of the radiating element, at a position that is intermediate the feed pin and the second radiating width-edge and is spaced from the second radiating width-edge.

21. The PIFA of claim 20 wherein the ground plane element and the radiating element are planar elements.

22. The PIFA of claim 21 including:

a metal capacitive loading plate extending from the first radiating width-edge in a direction toward the ground plane element without physically contacting the ground plane element.

23. The PIFA of claim 21 including:

a metal extending-plate extending from the second radiating width-edge in a direction toward the ground plane element without physically contacting the ground plane element;

a metal capacitive loading plate extending from the extending-plate in a direction generally parallel to the ground plane element, spaced from the ground plane element and generally parallel to the ground plane element;

a dielectric block located intermediate the capacitive loading plate and the ground plane element; and mounting means associated with the capacitive loading plate, the dielectric block, and the ground plane element joining the radiating element, the dielectric block and the ground plane element as a unitary PIFA assembly.

24. The PIFA of claim 20 wherein the ground plane element and the radiating element are both planar elements, including a first metal capacitive loading plate extending from the first radiating width-edge in a direction toward the ground plane element without physically contacting the ground plane element;

a metal extending-plate extending from the second radiating width-edge in a direction toward the ground plane element without physically contacting the ground plane element;

a second metal capacitive loading plate extending from the extending-plate in a direction generally parallel to the ground plane element, spaced from the ground plane element and generally parallel to the ground plane element;

a dielectric block located intermediate the second capacitive loading plate and the ground plane element; and mounting means associated with the second capacitive loading plate, the dielectric block, and the ground plane element for joining the radiating element, the dielectric block, and the ground plane element as a unitary PIFA assembly.

* * * * *